US009966055B2

(12) United States Patent
Pagliere

(10) Patent No.: US 9,966,055 B2
(45) Date of Patent: May 8, 2018

(54) DIGITALLY PITCH-SHIFTED PEDAL STEEL GUITAR

(71) Applicant: Alan Pagliere, Ann Arbor, MI (US)

(72) Inventor: Alan Pagliere, Ann Arbor, MI (US)

( * ) Notice: Subject to any disclaimer, the term of this patent is extended or adjusted under 35 U.S.C. 154(b) by 0 days. days.

(21) Appl. No.: 15/677,565

(22) Filed: Aug. 15, 2017

(65) Prior Publication Data

US 2018/0053494 A1 Feb. 22, 2018

Related U.S. Application Data

(60) Provisional application No. 62/376,146, filed on Aug. 17, 2016.

(51) Int. Cl.

| | |
|---|---|
| ***G10H 1/06*** | (2006.01) |
| ***G10H 3/18*** | (2006.01) |
| ***G10H 1/053*** | (2006.01) |
| ***G10H 1/34*** | (2006.01) |
| ***G10H 7/00*** | (2006.01) |
| ***G10H 1/44*** | (2006.01) |

(Continued)

(52) U.S. Cl.

CPC ..... *G10H 3/186* (2013.01); *G10H 1/053* (2013.01); *G10H 1/18* (2013.01); *G10H 1/346* (2013.01); *G10H 1/348* (2013.01); *G10H 1/44* (2013.01); *G10H 7/006* (2013.01); *G10D 1/08* (2013.01); *G10H 2210/325* (2013.01); *G10H 2210/331* (2013.01); *G10H 2210/401* (2013.01); *G10H 2210/581* (2013.01); *G10H 2220/096* (2013.01)

(58) Field of Classification Search

CPC ..... G10H 1/32; G10H 3/181; G10H 3/143; G10H 3/146; G10H 3/18; G10H 3/186; G10H 2220/471; G10H 1/342; G10H 2220/475; G10H 2220/525; G10H 3/14; G10H 1/055; G10H 3/00; G10H 3/182; G10H 2250/451; G10H 2250/511; G10D 1/085

See application file for complete search history.

(56) References Cited

U.S. PATENT DOCUMENTS 1,392,053 A * 9/1921 Harrington ..... G10D 1/08 84/285
2,458,263 A * 1/1949 Harlin ..... G10D 1/08 84/207

(Continued)

*Primary Examiner* — Marlon Fletcher
(74) *Attorney, Agent, or Firm* — Harness, Dickey & Pierce, P.L.C.

(57) ABSTRACT

The pedal steel guitar has a plurality of strings strung across the body, with at least one multi-element transducer positioned proximate the strings. At least one foot pedal or knee lever, carried by the body and being physically disengaged from the plurality of strings, is coupled to at least one sensor that produces an electronic sensor signal when the pedal or lever is moved. A digital signal processor receives the electronic transducer signal and the electronic sensor signal and operates on the electronic transducer signal in the digital domain. The processor uses the electronic sensor signal to manipulate at least one tonal property of the electronic sensor signal. The digital signal processor produces an audio output. The digital signal processor is programmed to change the manner in which the digital signal processor manipulates the at least one tonal property based on programming information received through a programming input.

28 Claims, 19 Drawing Sheets

(51) Int. Cl.
*G10H 1/18* (2006.01)
*G10D 1/08* (2006.01)

(56) References Cited

U.S. PATENT DOCUMENTS 2,459,102 A * 1/1949 Adair ..... G10D 1/08 84/312 P
2,610,536 A * 9/1952 Cousineau ..... G10D 1/085 84/297 R
2,914,982 A * 12/1959 La Bossier ..... G10D 1/08 84/267
2,973,682 A * 3/1961 Fender ..... G10D 1/08 84/297 R
3,352,188 A * 11/1967 Fender ..... G10D 1/08 84/312 P
3,390,600 A * 7/1968 Kelley, Jr. ..... G10D 1/08 74/479.01
3,404,595 A * 10/1968 Harlin ..... G10D 1/08 84/312 P
3,407,697 A * 10/1968 Jackson ..... G10D 1/08 84/312 P
3,447,413 A * 6/1969 Emmons ..... G10D 3/143 84/312 P
3,452,635 A * 7/1969 Sebers ..... G10D 1/08 84/306
3,733,954 A * 5/1973 Fields ..... G10D 3/143 84/297 R
4,024,787 A * 5/1977 Larson ..... G10D 1/085 84/173
4,106,386 A * 8/1978 Rotramel ..... G10C 1/00 84/10
4,704,935 A * 11/1987 Franklin ..... G10D 3/143 84/294
5,883,320 A * 3/1999 Lashley ..... G10D 1/00 84/312 P
5,973,252 A 10/1999 Hildebrand
6,852,919 B2 2/2005 Ludwig
6,995,311 B2 2/2006 Stevenson
7,309,829 B1 12/2007 Ludwig
8,618,393 B1 * 12/2013 Peters ..... G10G 5/005 84/327
9,076,412 B1 7/2015 Rolling
9,263,005 B1 2/2016 Moushon et al.
2002/0005108 A1 1/2002 Ludwig
2007/0034070 A1 * 2/2007 Hammond ..... G09B 15/02 84/477 R
2012/0174731 A1 7/2012 Hildebrand
2016/0019871 A1 * 1/2016 Jackson ..... G10D 3/143 84/312 P
2017/0032775 A1 * 2/2017 Schlessinger ..... G10H 3/146

* cited by examiner

| | A | B | C | LKL | LKR | RKL | RKR |
|---|---|---|---|---|---|---|---|
| F# 4 | | | | | | +2 G# | |
| D# 4 | | | | | | +1 E | -1D / -2 C# |
| G# 4 | | +1 A | | | | | |
| E4 | | | +2 F# | +1 F | -1 D# | | |
| B3 | +2 C# | | +2 C# | | | | |
| G# 3 | | +1 A | | | | -2 F# | |
| F# 3 | | | | | | | |
| E3 | | | | +1 F | -1 D# | | |
| D3 | | | | | | | -1 C# |
| B2 | | | | | | | |

FIG. 6

| | A | B | C | D | E | LKL | LKV | LKR | RKL | RKR |
|---|---|---|---|---|---|---|---|---|---|---|
| min | 250 | 250 | 250 | 250 | 250 | 250 | 250 | 250 | 250 | 250 |
| max | 325 | 325 | 325 | 325 | 325 | 405 | 405 | 405 | 405 | 405 |

DIGITALLY PITCH-SHIFTED PEDAL STEEL GUITAR

CROSS-REFERENCE TO RELATED APPLICATIONS

This application claims the benefit of U.S. Provisional Application No. 62/376146, filed on Aug. 17, 2016. The entire disclosure of the above application is incorporated herein by reference.

FIELD

The present disclosure relates generally to musical instruments and specifically to a pedal steel guitar instrument. More particularly, the disclosure relates to improvements in functional features and workings of the pedal steel guitar instrument, including improvements in the way the shifting of the pitches of individual strings is achieved; the way in which the instrument's pedals and knee levers, engaged by the player during the normal playing of the instrument, control the strings' pitch changes; and the way in which the parameters that govern the changes are programmed and used by the player.

BACKGROUND

The traditional pedal steel guitar was developed in about the middle of the $20^{th}$ century. In the traditional instrument, the strings' pitches may be altered by machinery that physical stretches and loosens the strings. These pitch changes can be done while playing the instrument. The mechanical nature of the machinery used to alter the strings' pitches can be seen in FIGS. 1-5. As illustrated, the traditional instrument includes a body 10 to which front and back legs 12 are attached, allowing the instrument to be positioned at a comfortable playing height while seated. Positioned atop the body 10 is the neck 18 of the instrument. Frets are not used in a pedal steel guitar; the neck simply has fret markings to aid the player in positioning the slide across the strings while playing. The strings 19 are stretched across the body between the tuning pegs 20 and the bridge 22. Near the tuning peg end of the neck, the strings are tensioned across a roller nut 24, which allows individual strings to spread their tension over the full length of the string from bridge to tuning peg. The roller action of the nut helps avoid some hysteresis that would otherwise result in undesirable detuning as the instrument is played.

In the traditional instrument, each string has its own individual bridge 22 so that its tension can be altered individually (i.e., per string) as its bridge rolls towards or away from the nut. The rolling action of the bridge is accomplished by pulling on mechanical changers under each bridge. These changers are disposed inside, on the underside of the body, with access to the changers and supporting linkages being provided by a hole in the endplate 26. The series of mechanisms that impart motion of the foot pedals into movement of the bridge can be seen in FIG. 2. As illustrated, the pedal rod 30 (attached at the distal end to the pedal 16) pulls on rocker 19 against the force of spring 21. A travel stop screw 23 limits the movement of the rocker when the pedal is engaged. The rocker is attached to cross rod 25, which imparts motion to the bell crank 27. Similarly, the mechanisms that impart motion of the knee levers into movement of the bridge can be seen in FIG. 3. The knee lever 34 rotates cross rod 31 causing bell crank 33 to move. These mechanisms operate pull rods that move the changer fingers which in turn rotate the bridge to stretch or loosen selected strings, as seen in FIG. 4. As illustrated, the string 19 wraps around the movable bridge that is controlled by pull rods 35 that operate a raise finger 37 and a lower finger 39. Tuning nuts 41 adjust how much tuning change is effected when a pitch raise or lower is commanded by the corresponding pull rod. A return spring 43 biases the entire mechanism to a state of rest when the knee levers or pedals are not being operated.

Attached across the base of the front legs is a pedal bar or rack 14 that supports a plurality of foot pedals 16. Three pedals are illustrated in FIG. 1, but different numbers of pedals may be utilized. The pedals are connected by pedal rods 30 to the mechanisms inside, beneath the body. The pedal rods 30 are supported by the front apron 32. Connected to the back apron (not visible in FIG. 1) are a series of knee levers 34 that also operate through mechanisms that also effect changes in string tuning.

In the traditional instrument, a monophonic pickup 28 is mounted on the body, near the bridge 22. In the traditional instrument this pickup employs a magnetic solenoid that magnetically couples to the instrument's metal strings. When the strings vibrate, this string motion produces changes in magnetic flux, causing an electric current to flow in the solenoid, which is then conducted by a two-conductor cable to an analog amplifier (e.g., guitar amplifier). The pickup is positioned so that the strings pass over and in near proximity to the pickup, thus establishing good magnetic coupling between pickup and strings. In the traditional pedal steel instrument the pickup is monophonic. This means that vibratory movement of one or more strings are collectively captured as a single monophonic signal in which the sounds of the individual strings are merged into a single monaural output.

Because a traditional pedal steel guitar uses machinery to physically change the tension of strings to achieve musical pitch changes, it suffers from a number of problems and limitations which are inherent in the design of that machinery. The present disclosure solves a number of these problems and removes a number of these limitations, including but not limited to the following:

Weight: A traditional pedal steel guitar is heavy, due in great part to the necessary inclusion of the machinery.

String fatigue and breakage: In a traditional pedal steel guitar, the constant changes in string tension cause wear on the strings themselves, weakening them and causing their tone to degrade over time. Strings can break and it is usually necessary to replace strings often.

"Splits": In a traditional pedal steel guitar, when a string can be altered by more than one pedal, and the pedals individually alter the string tension in opposite directions, the resultant pitch will often be slightly out of tune. For example, one pedal, when engaged alone, might raise a string's pitch a whole step while another pedal, when engaged alone, might lower the same string a half step. When both pedals are engaged simultaneously, the sum of the two changes should result in a half step raise of the string. However, it is often the case that the sum of the physical tension changes is not precise and the resulting pitch is not precisely the intended pitch. Compensation is necessary, which usually takes one of several forms: an adjustment of the bar held in the player's left hand while playing; the manipulation of how rods and changers are connected and adjusted (with the concomitant effort and time to make these adjustments, sometimes requiring the help of someone specializing in working on pedal steel guitars); or the use of "compensators" (added machinery, with concomitant added complexity and weight) to make up for the difference.

"Cabinet drop": In a traditional pedal steel guitar, string tension changes associated with engaging of pedals can stress the body of the instrument enough to cause other strings, not intended to be altered by these pedals, to be temporarily slightly out of tune. Some conventional pedal steel guitars are outfitted with "compensators" to adjust for this problem.

Pedal travel and "feel": The kinesthetic sensation and physical feedback that a traditional pedal steel guitar player senses and how far a pedal travels in order to fully engage must often be adjusted by physically altering where on a bellcrank and/or on a changer a pull rod is attached since different positions have different travel and leverage.

Half-pedaling: If a pedal/lever raises or lowers a string by a whole step, a player can engage the pedal/lever only part way and achieve a pitch change of a half-step. This requires experience and skill. In some cases, traditional pedal steel guitars are equipped with adjustable springs to help the player feel when the half-way point is near or has been reached. Without such an adjustment, getting a half-pedal to sound in tune is difficult. With an adjustment, the extra effort of tuning the adjustment is required.

SUMMARY

The present disclosure addresses the aforementioned problems and limitations of the traditional pedal steel guitar, without altering the distinctive sound of the instrument, or the manner in which it is played. This is accomplished by providing a digitally pitch-shifted pedal steel guitar that implements a copedent through the use of controlled pitch-shifting by digital signal processing rather than through the use of a physical mechanism to change the tension of strings. The term copedent is a term of art used by pedal steel guitar players to describe how string tunings, foot pedals and knee levers are combined to effect different tunings of the instrument. Copedent information is often expressed in table form, showing what pitch is developed for each open string (unfretted or unstopped) for a given combination of pedal and knee lever engagements. Thus the digitally pitch-shifted pedal steel guitar of the present disclosure implements copedent operation by digital electronic means rather than by changing physical string tensions.

More specifically the "copedent" is the logical heart of a pedal steel guitar. A copedent is depicted as a table with rows representing strings and columns representing pedals and knee levers. The intersection of the rows and columns contain the pitch changes that particular pedals/levers may make to particular strings. A copedent is realized in a traditional pedal steel guitar in the physical realm by mechanical means through the machinery (i.e., rods and bell cranks and changers) and as these mechanical components are affected by engaging the pedals and knee levers, the tension and pitch of one or more strings will change continuously up to, or down to, the pitch shown in the copedent.

By contrast, the present disclosure realizes copedents using digital signal processing. Doing so allows copedents to be created, edited, saved, recalled and used in playing, through the use of electronic components and processors. Changes in pitch are achieved by real-time digital signal processing which is continuously controlled by data from the software (processor instructions), as explained in the present disclosure, as the processor takes data input from sensors measuring the travel ranges of each pedal/lever.

In addition to addressing the aforementioned problems with traditional pedal steel guitar instruments, the digitally pitch-shifted instrument eliminates a variety of shortcomings of the traditional instrument, and offers a number of unique advantages, including but not limited to the following:

Need to tune pedals: On a typical traditional pedal steel guitar, the strings of course are tuned while open. In addition, the pedals and knee levers need to be tuned as well; that is, the pitch which strings will reach when pedals that affect them are engaged need to be tuned as well. This usually involves using a wrench to turn a nut on the end of a pull rod such that the effective length of the pull rod is slightly changed. This in turn will cause a change in the tension ultimately reached when a pedal is fully engaged, which in turn changes the ultimate pitch reached.

Difficulty in changing copedents: If a traditional pedal steel guitar player wants simply to experiment with a new copedent, or even make a small adjustment to an existing copedent in the form of a single simple pedal change, time and effort are required to remove and reinstall parts of the machinery, make adjustments, and retune. Restringing the instrument with strings of different gauges might also be required.

Number of necks: Most traditional pedal steel guitars have one or two necks of ten or twelve strings each (though other numbers of strings per neck are possible), each with a range of string gauges appropriate for the strings' open-tuned pitches. Two necks afford a traditional pedal steel guitar player two different copedents with different sounds, often used for different styles of music. The history of the traditional pedal steel guitar and the styles of music traditionally played on it have steered the evolution of two main standard copedents, though others do exist. Many players also add a few personal changes to otherwise standard copedents.

Number of raises and lowers per string: A "raise" is the increase in tension, and raise in pitch, by one pedal of one string. A "lower" is the decrease in tension, and lowering in pitch, by one pedal of one string. Most traditional pedal steel guitars have a limit, due to their physical design, of the number of raises and lowers on any one string. For example, many traditional pedal steel guitars afford no more than three raises and two lowers.

Physical limit on range of intervals: There is a natural, physical limit on how much a string can be tightened without its breaking or loosened while still maintaining playability and tone. Most traditional pedal steel guitars do not raise or lower a string more than a minor third, or perhaps major third.

Playability identical to the traditional pedal steel guitar: The present disclosure's elimination of the machinery of the traditional pedal steel guitar, while keeping other parts and aspects of the traditional pedal steel guitar (namely, those with which the player comes into contact when playing; e.g., strings, pedals, knee levers), the manner in which a player interacts with the instrument remains unchanged and the player does not need to alter anything about their technique or acquire new skills.

Reduced weight: By eliminating the machinery of a traditional pedal steel guitar, the instrument can be made to be much lighter, facilitating transportation and set up.

Ease of maintainability: The elimination of the machinery, including the roller nut and moving changers (at the bridge end) of the traditional pedal steel guitar also eliminates nearly all of the mechanical maintenance work that a pedal steel guitar player does to keep the instrument in playable condition and eliminates most worries about tuning the instrument.

Effectively zero string fatigue and string breakage: By removing the need to stretch or loosen strings physically, string fatigue and breakage are essentially eliminated. Again, no machinery is needed, only a simple bridge and a simple nut are required on which to mount the strings, making building and maintenance of the physical parts of the instrument simpler and less expensive.

Programmable, storable, recallable copedents: By using electronic hardware and software along with pitch-shifting DSP to manipulate strings pitches, the player is, without physical effort, specialized knowledge or skill in the maintenance of the machinery of the instrument, free to create, change, store, and recall any number of copedents and be assured that they will be in tune without the effort of changing strings or retuning the pedals. With a reasonable number of physical pedals and knee levers (for example, five pedals and five knee levers, though more are possible) essentially all existing common copedents as well as an unlimited number of copedents never before possible are easily implemented. Furthermore, changing between stored copedents takes only moments using the user interface.

Virtual capo: Capos exist for guitars which allow a player to raise by half-steps the pitches sounded by the open-tuned strings by physically stopping the strings at a position between the nut and bridge of the instrument, effectively acting as a new nut. Capos do not exist for the traditional pedal steel guitar (such a capo would have to have a roller mechanism and would be extremely difficult to install and remove). The present disclosure affords the player the ability to virtually capo (through digital pitch shifting) the chosen tuning/copedent by half-steps, up in pitch or even down (something not even physically possible in a traditional pedal steel guitar or regular guitar).

Tuning adjustments: Since pedal/lever-affected pitches as well as open strings need to be tuned on a pedal steel guitar, when accompanying other instruments which may not be tuned to standard pitch, retuning a traditional pedal steel guitar to match them is tedious and time-consuming (requiring retuning strings and retuning pedals/levers). The present disclosure can digitally adjust the entire tuning of the instrument by any amount. For example, one can easily move the entire instrument's tuning and copedent up or down by any number of cents (1 cent=1/100 of a semitone).

Pedal "feel": A traditional pedal steel guitar player senses the change in string tension while playing. The amount of pressure needed to engage a pedal or lever and the resistance felt are a function of the string tension itself and the different amounts of leverage at each point in the machinery related to that pedal/string change. The present disclosure allows for the simplification of this aspect of the adjustment and maintenance of a pedal steel guitar. For example, one embodiment of a pedal steel guitar incorporating the present disclosure would use a physically adjustable spring for each pedal/lever. A return spring would be needed in any case for each pedal/lever, but as the strings themselves never change in tension, by making such a spring adjustable, the player could customize pedal feel independently of the tension of the strings affected.

In-tune splits: In the present disclosure, the behavior and precision of splits are managed by software control of pitch-shifting DSP. Therefore, when engaging multiple pedals that affect the same string, it is software control which accurately sums the programmed individual changes, causing the string to reach its final pitch precisely.

Half-pedaling: With the present disclosure's use of software-based pitch-shifting, a half-pedal is achieved by separately saving, as part of a saved copedent, a pitch that falls within the pitch interval from virtual open string pitch to the pitch achieved by fully engaging a pedal. For example, if a pedal raises a string a major third, a half-step raise could be saved as a "half-pedal" position such that as the player approaches a particular physical point within the full travel range of a pedal/lever, the pitch of the output is "attracted" to a half-step above the open pitch of the string. As the pedal/lever travels past a threshold beyond that point, that "attractor," the remaining interval of the pitch-shift continues to be applied (in this case, a minor third). In this sense, the term "half pedal" is a somewhat inaccurate term since the "half-pedal" pitch is not half of the interval corresponding to the full travel of the pedal. This could even be implemented on more than one string where the strings are affected by the same pedal.

A "multiple stop half-pedal" is also possible. The player may choose to have more than one intermediate position/pitch/attractor.

A "multidirectional half-pedal" is also possible to have a "half-pedal" that changes direction. For example, a pedal could begin to lower a string's pitch until it reaches an intermediate travel position, or "attractor." As the pedal continues past that position, it could change direction and raise the string to some other pitch, identical to or different from its original virtual open pitch.

"Meta-splits": The present disclosure allows for one or more particular pedals to be programmed in such a way that they alter the behavior of another pedal or pedals, as opposed to merely summing their own change(s) with the change(s) of another pedal or pedal, as in the case of splits.

Size of pitch intervals: As the pitch changes are no longer dependent upon the physical changing of string tension, there are no theoretical limits to the interval to which a string's pitch may be raised or lowered.

Most of these enhanced and unique behaviors are impossible on a traditional pedal steel guitar.

Therefore, according to one aspect of the present disclosure, the instrument includes a body, legs, a plurality of strings, a plurality of pedals and/or knee levers in the general structure and configuration of a traditional pedal steel guitar. A plurality of transducers to capture the vibration of each string individually is deployed on the instrument. A plurality of analog to digital converters (ADC) convert analog vibrations of the strings into digital signals that are then operated upon by a digital signal processor.

The digital signal processor is programmed to independently digitally pitch shift (e.g., by means of software-based DSP), in real time, the separate digital signal outputs of the ADCs. The digital signal processor receives messages sent by a main control program which encapsulate sensed data indicative of the travel of each pedal and/or knee lever. The signals, after processing are both summed and sent to a DAC (or sent to multiple DACs and then summed in the analog realm) for output as standard pedal steel guitar output and also kept separate for output as independent digital signals, one per string for further external processing if so desired.

A user interface is further provided through which the user or player can interact with the electronic aspects of the instrument.

Although the digitally pitch-shifted instrument handles copedency electronically, the instrument nevertheless has a familiar, traditional feel to the player. This is accomplished through springs attached to the pedals and knee levers to provide physical resistance and therefore kinesthetic feedback to the player of the instrument. These same springs also cause the pedals and knee levers to return to their original, at-rest position after being released by the player. As a result, the instrument feels like a traditional pedal steel guitar, even though the tunings are produced by an entirely different means. Thus while the disclosed instrument differs from a traditional pedal steel guitar instrument in a number of important respects, it remains playable in precisely the same way as a traditional pedal steel guitar.

Moreover, all features and advantages of the disclosed digitally pitch-shifted pedal steel guitar require no alteration to the way in which the instrument is played. Therefore, no changes in knowledge, skills, or techniques are required by a traditional pedal steel guitar player when moving to a pedal steel guitar incorporating the present disclosure. The player needs to invest no time or effort in learning new techniques required to play a new instrument.

Software (program instructions) running on a microprocessor or other processor for copedent control is capable of modifying, saving, recalling software-based copedents and of calculating, based on pedals/knee levers travel sensor output, control information to be sent to the DSP processor(s).

BRIEF DESCRIPTION OF THE DRAWINGS

The drawings described herein are for illustrative purposes only of selected embodiments and not all possible implementations, and are not intended to limit the scope of the present disclosure.

Several drawings of an exemplary traditional pedal steel guitar are included as context for what improvements are made by the disclosed invention; e.g., in the disclosed embodiment(s) no conventional pull rods are needed, nor are bellcranks or cross rods or changers needed; multiple output channels may be summed or taken separately; software implementation of copedents affords instantly changeable tunings, in-tune "splits," etc.

In the disclosed digitally pitch-shifted pedal steel guitar instrument, the pedals may transfer their travel to sensors housed in the body of the instrument by means of pedal rods, just as they do in the case of a traditional pedal steel guitar. Alternatively the pedals may be supported by attaching to the instrument legs or pedal bar/rack, or they may be freestanding and electrically coupled to the electronic circuitry by wire or wireless communication. The drawings here assume the first case.

Different kinds of pickups may be used as long as each string is given a separate audio channel. The drawings here assume magnetic pickups.

Figure 1:
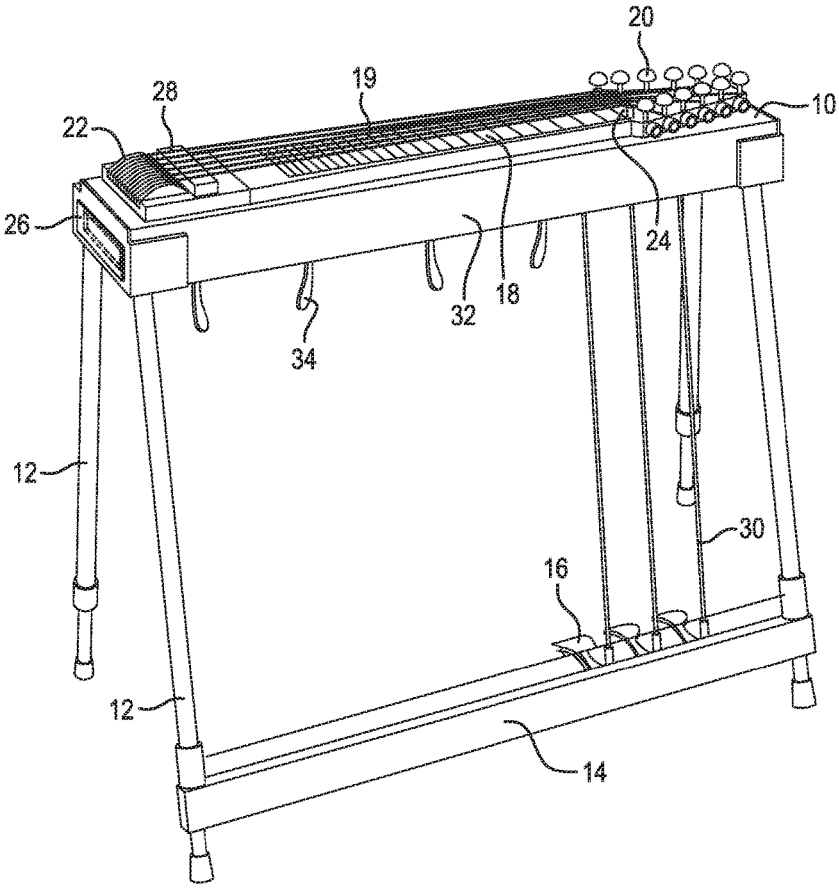
FIG. 1 Prior Art

FIG. 1 (prior art) is a perspective view of an exemplary traditional pedal steel guitar (traditional pedal steel guitar) instrument.

Figure 2:
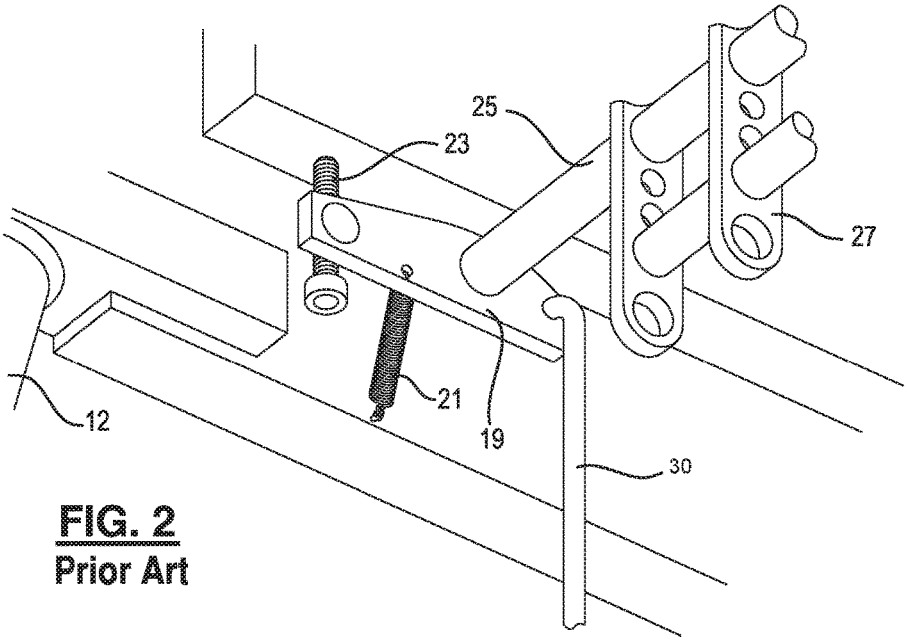
FIG. 2 Prior Art

FIG. 2 (prior art) is a perspective view of how a typical pedal rod is mounted to the underside of a traditional pedal steel guitar with its connection through a cross rod with attached bellcrank through to a pull rod.

Figure 3:
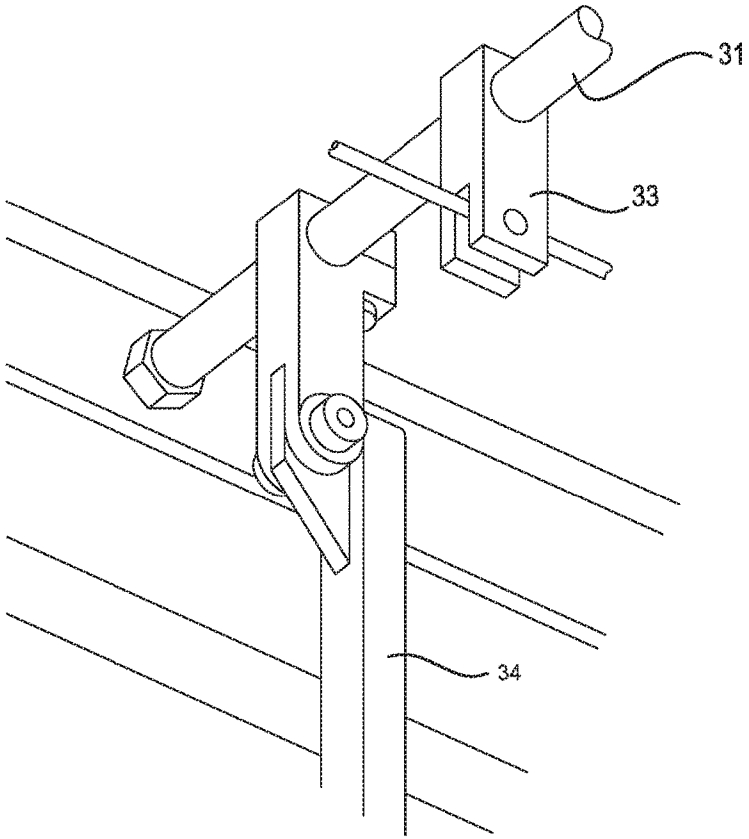
FIG. 3 Prior Art

FIG. 3 (prior art) is a perspective view of how a typical knee lever is mounted to the underside of a traditional pedal steel guitar.

Figure 4:
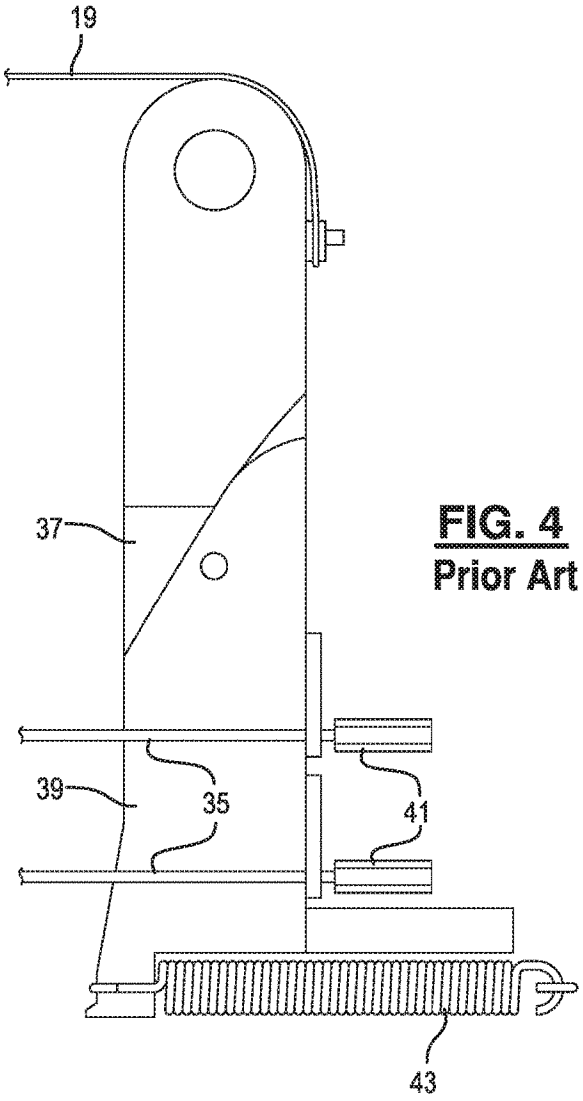
FIG. 4 Prior Art

FIG. 4 (prior art) is a perspective view of a pull rod connected to a changer at the bridge end of a traditional pedal steel guitar.

Figure 5:
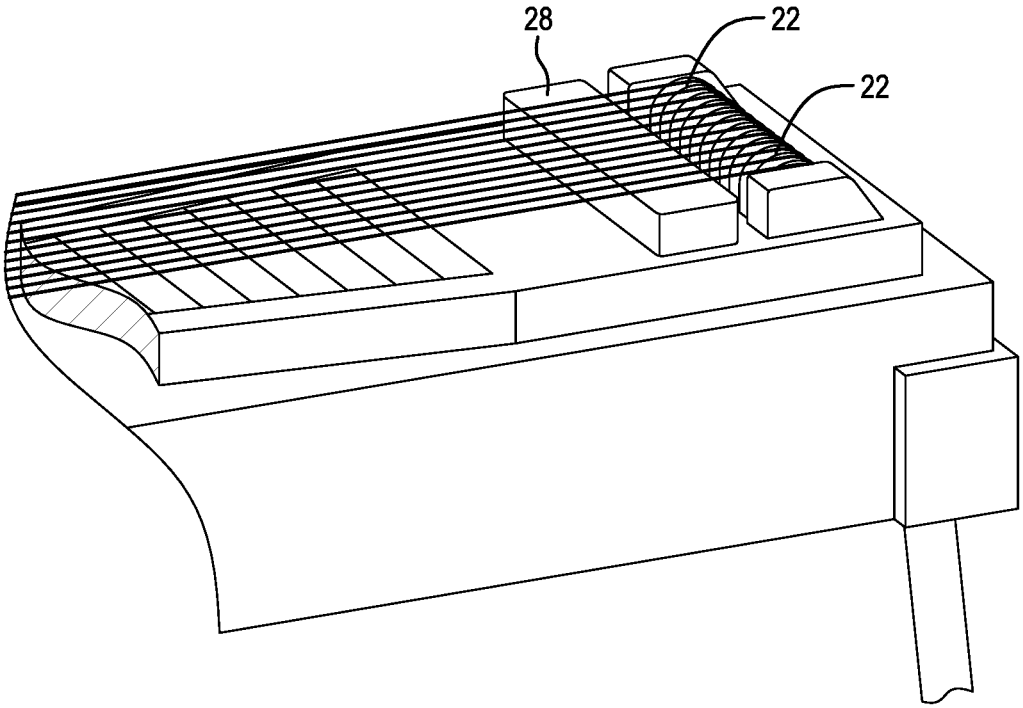
FIG. 5 Prior Art

FIG. 5 (prior art) is a perspective view of a typical pickup of a traditional pedal steel guitar, where one pickup is used for all strings.

FIG. 6 (prior art) is a table showing the usual way in which a copedent is conceptualized, written down, and shared.

Figure 7A:
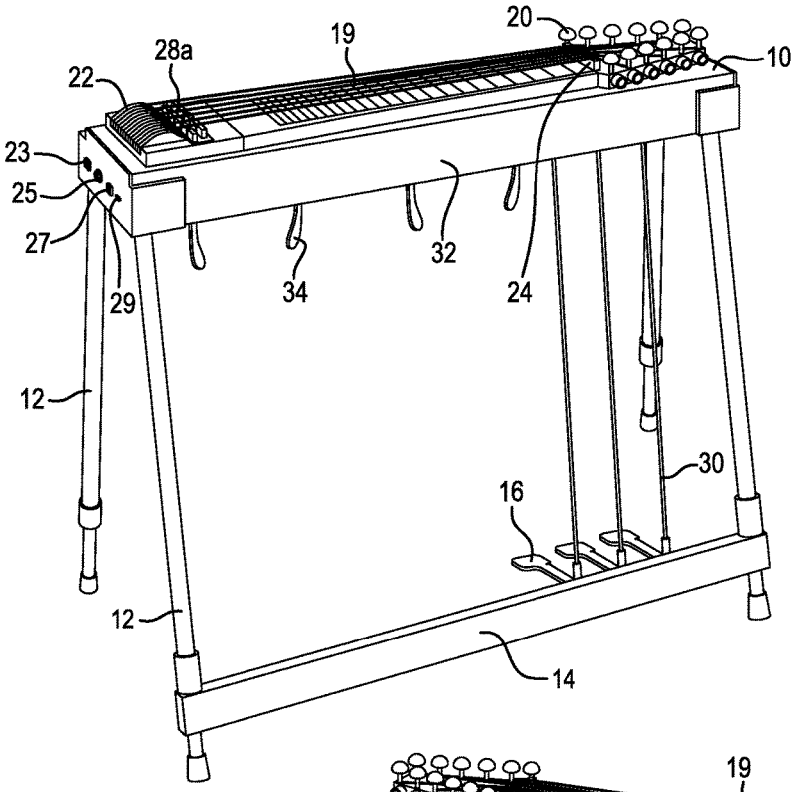
Figure 7B:
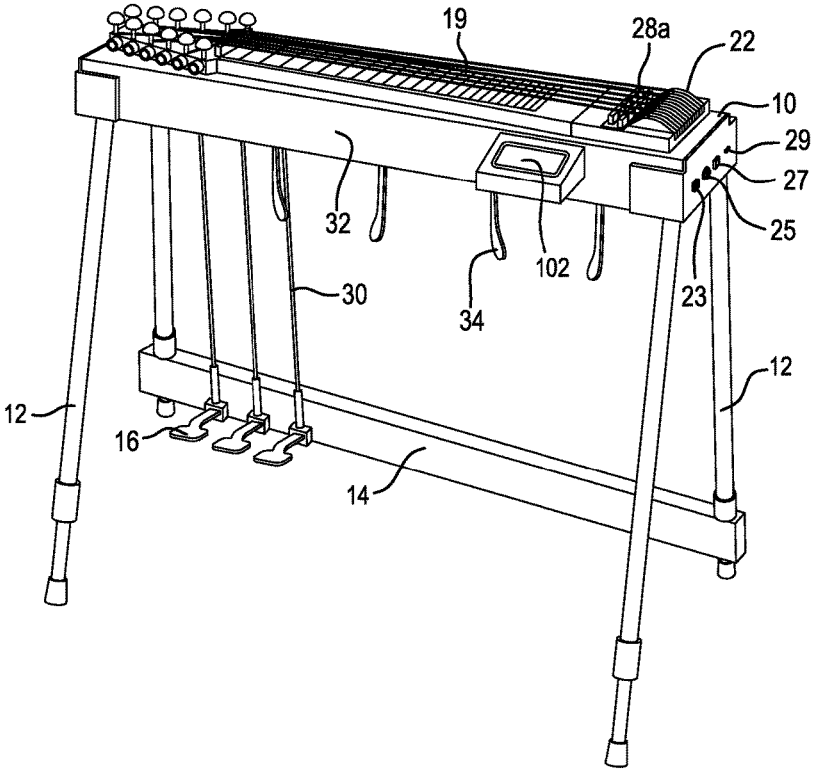

FIGS. 7A-7B (collectively referred to as FIG. 7) are perspective views of an example of a digitally pitch-shifted pedal steel guitar.

FIGS. 8A-8D (collectively referred to as FIG. 8) are views illustrating the mounting of a pedal rod to the underside of the instrument body employing a magnet and Hall Effect sensor.

Figure 9:
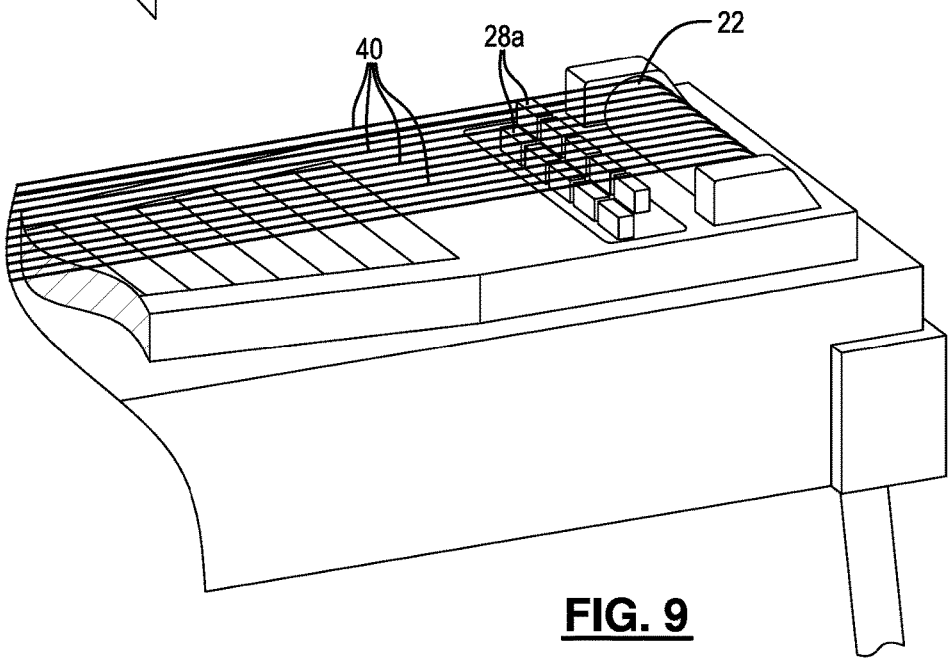

FIG. 9 is a perspective view, according to an aspect of the invention, of multiple magnetic single-string pickups employed to capture individual strings' vibrations separately.

The next several figures show a series of mockups of a touchscreen which is used by the player to interact with the software in order to configure various musical aspects and capabilities of the instrument.

Figure 10:
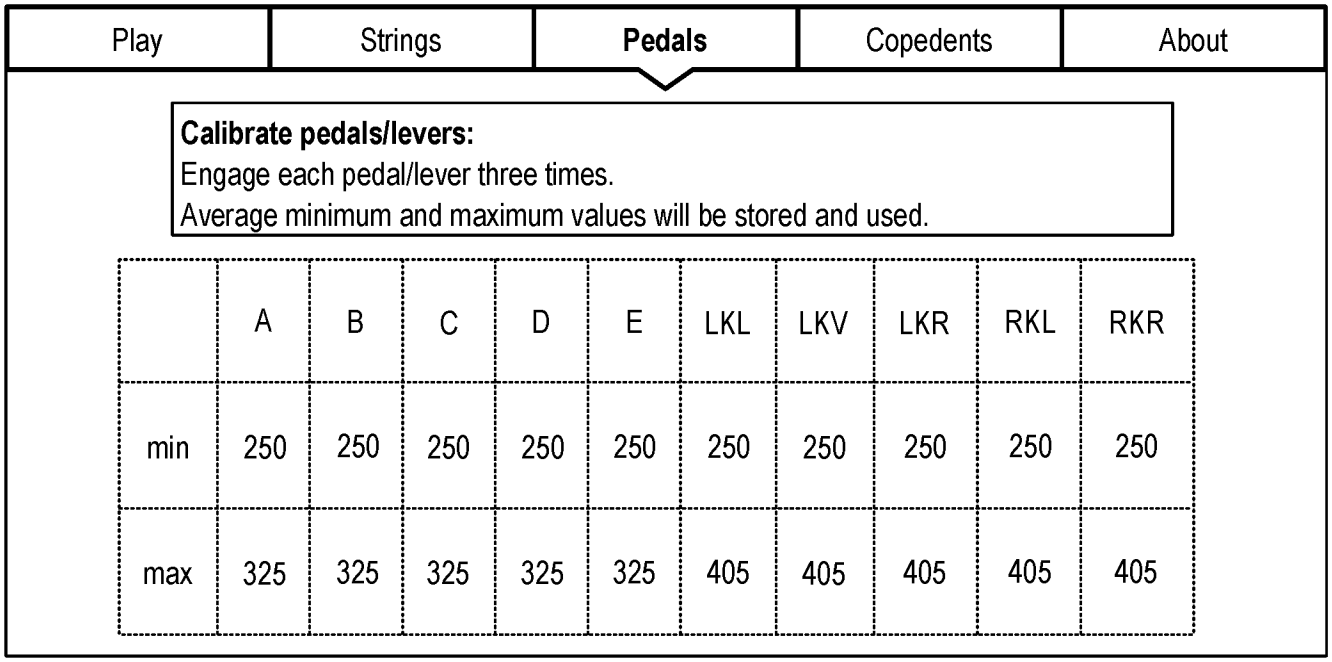

FIGS. 10 is an exemplary touchscreen which displays the minimum and maximum values of each of the sensors used on the pedals and knee levers. These values will be used by the main control program to calculate pedal and knee lever travel.

Figure 11:
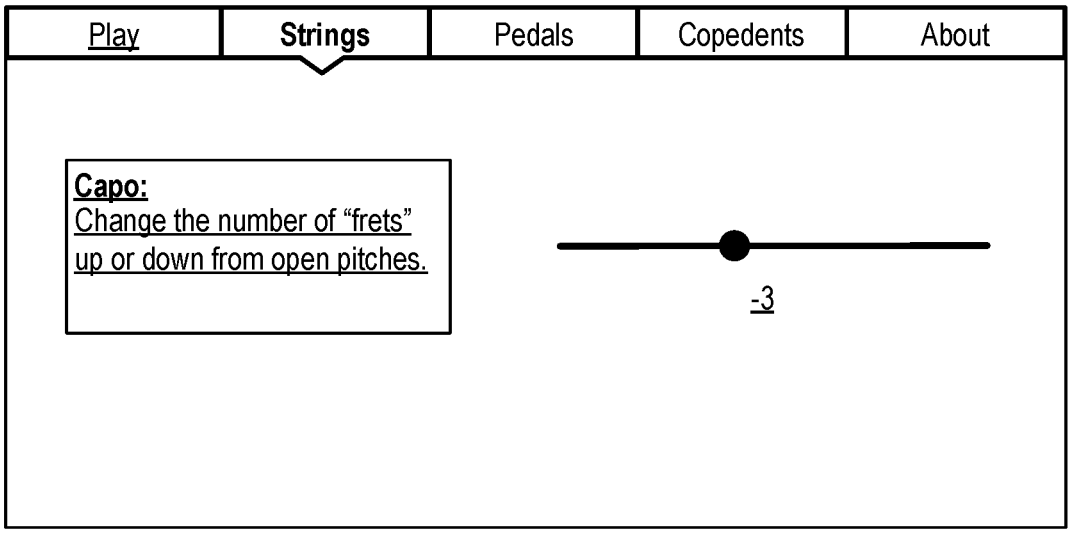

FIG. 11 is an exemplary touchscreen which allows the player to configure the virtual capo.

Figure 12:
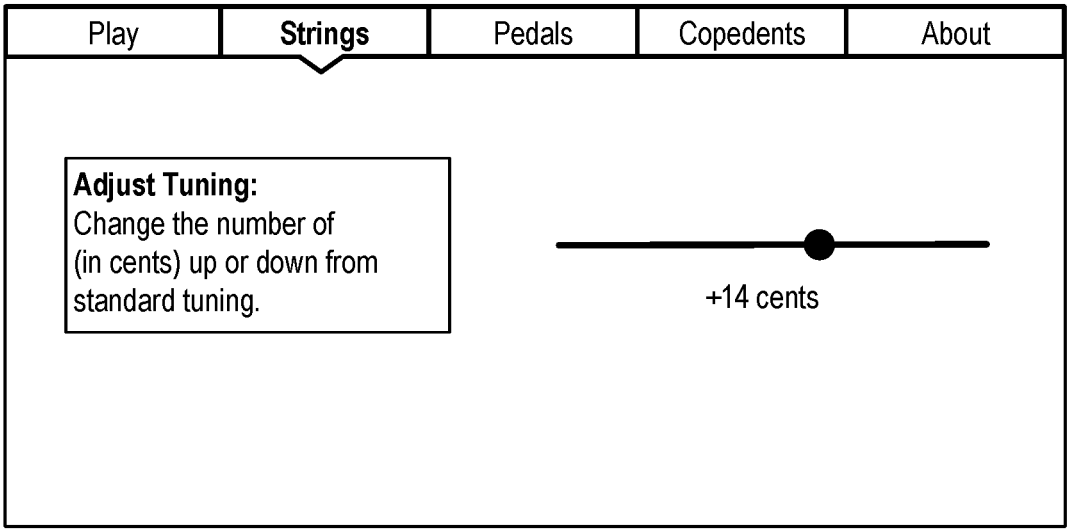

FIG. 12 is a mockup of the touchscreen which allows the player to configure a tuning adjustment for all strings.

Figure 13:
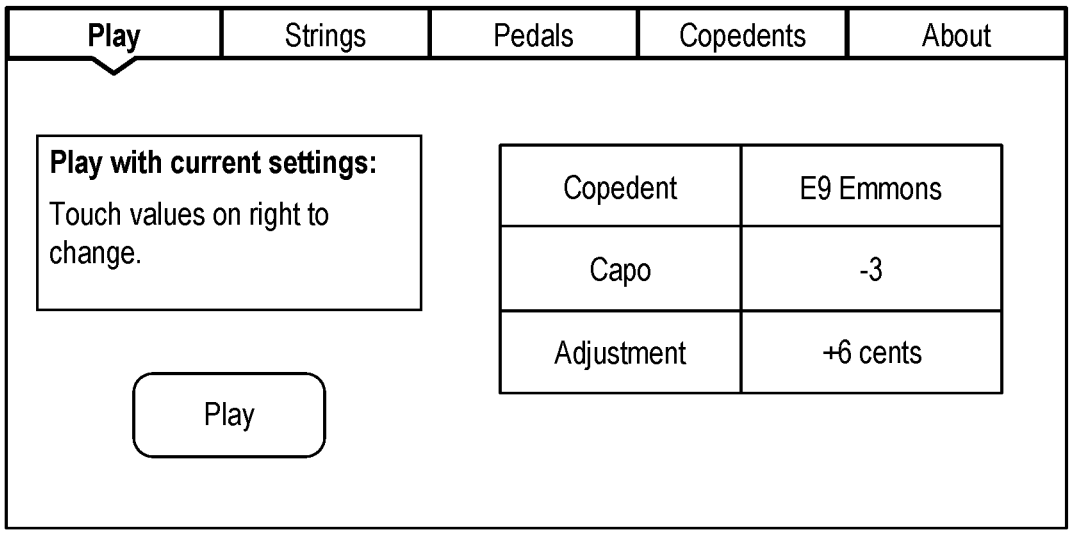

FIG. 13 is an exemplary touchscreen's main view or "home page," which displays to the player the values in effect which will be used when the player plays the instrument. It also allows the player to configure these values.

Figure 14:
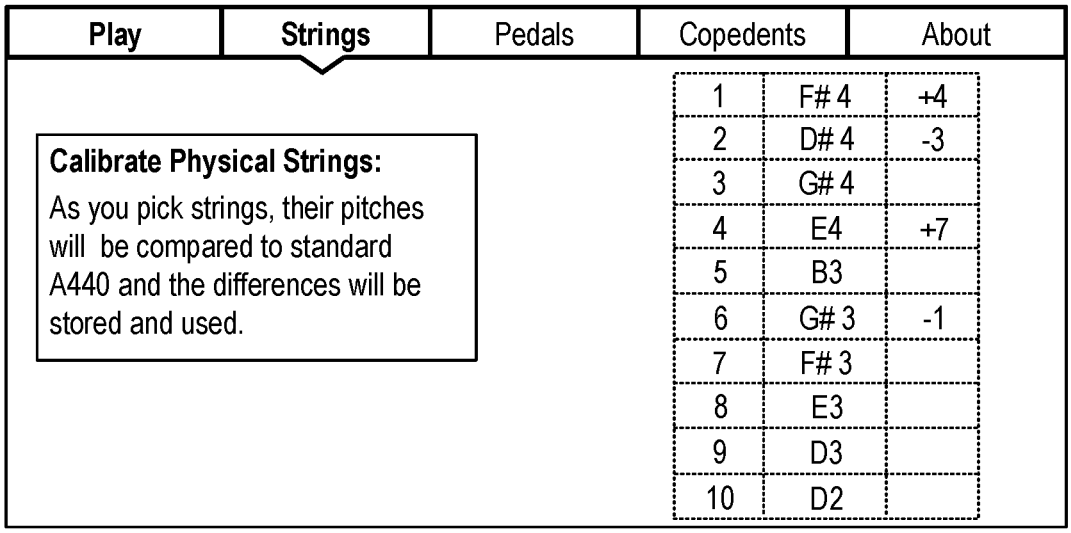

FIG. 14 is an exemplary touchscreen which displays to the player how far each physical open string's pitch is from its expected standard pitch. This allows the player to see the effects of adjusting the pitches of the physical strings by tuning them.

Figure 15:
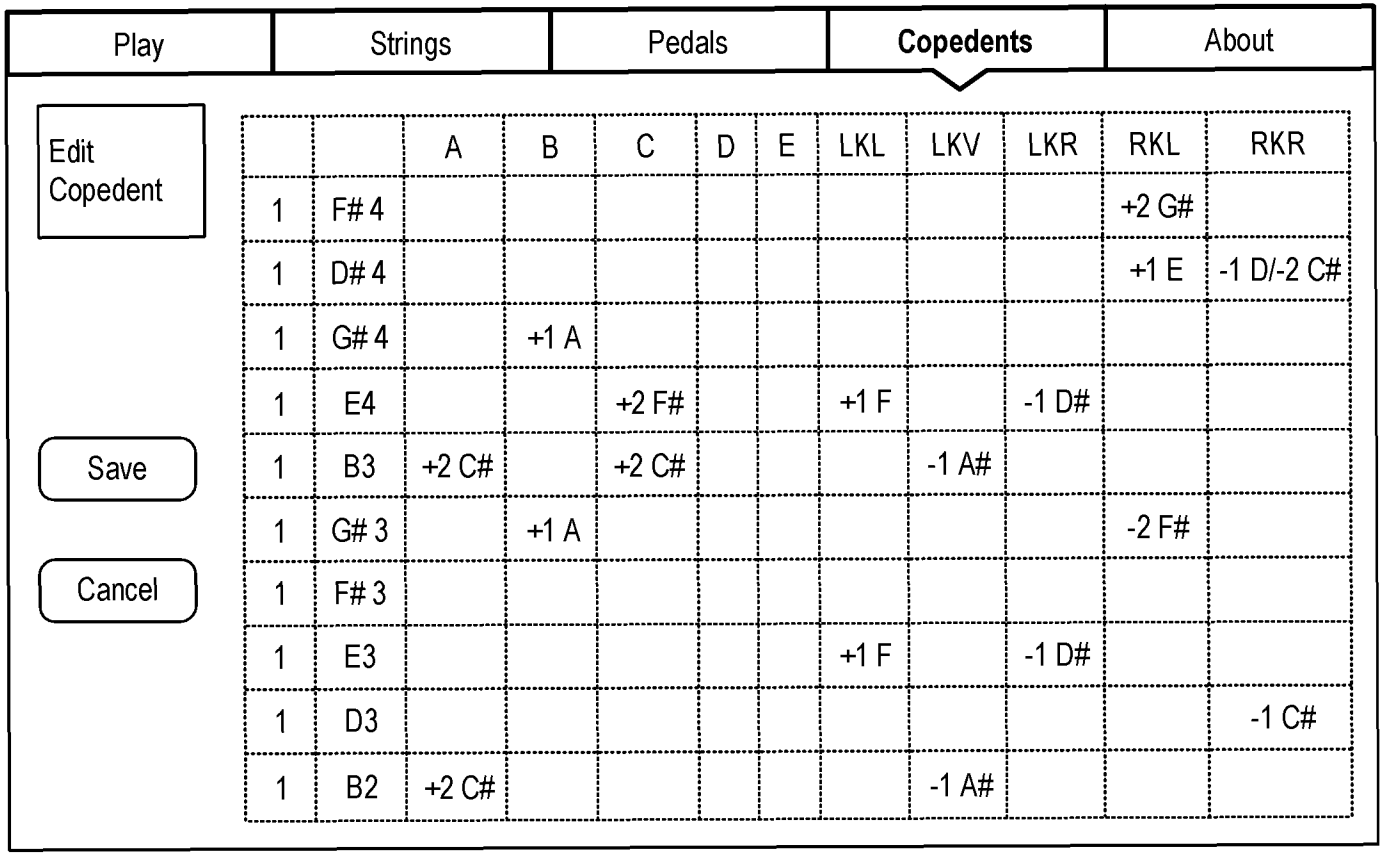

FIG. 15 is an exemplary touchscreen which allows the player to configure a copedent. Pitches of the virtual open strings as well as the changes realized by engaging the various pedals and knee levers are shown. Touching particular areas of the touchscreen give the player the opportunity to change these values.

Figure 16:
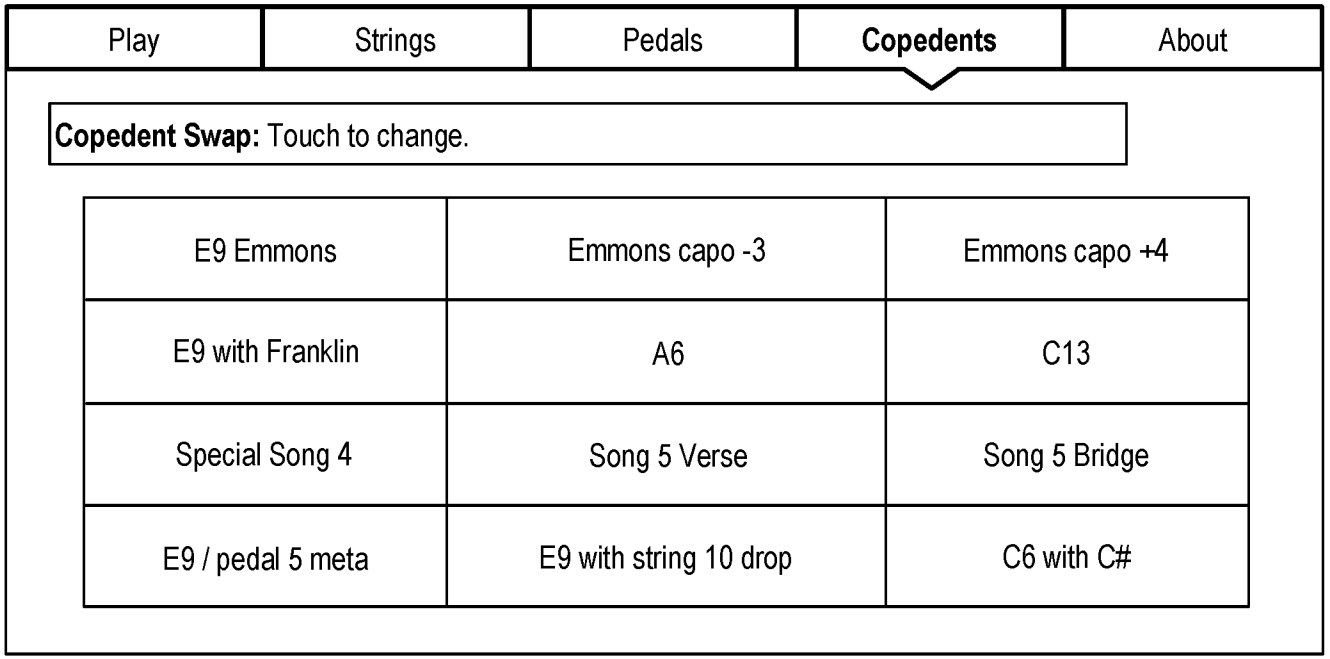

FIG. 16 is an exemplary touchscreen which allows the player to quickly choose the copedent in effect. Having several on the screen at once affords the opportunity to move between the displayed copedents by simply touching the associated area of the screen.

Figure 17:
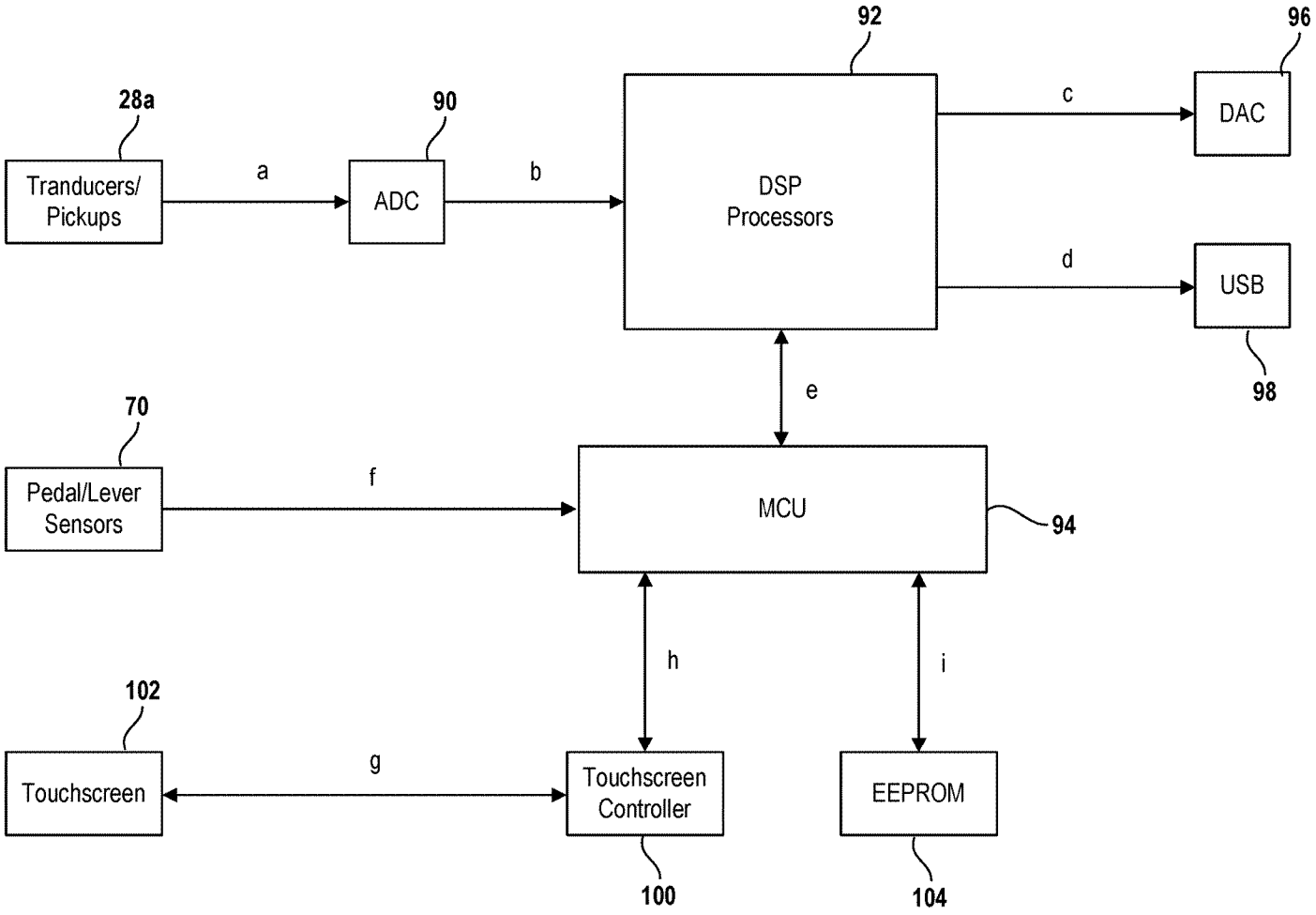

FIG. 17 is a block diagram of the processing hardware according to the present invention.

Figure 18:
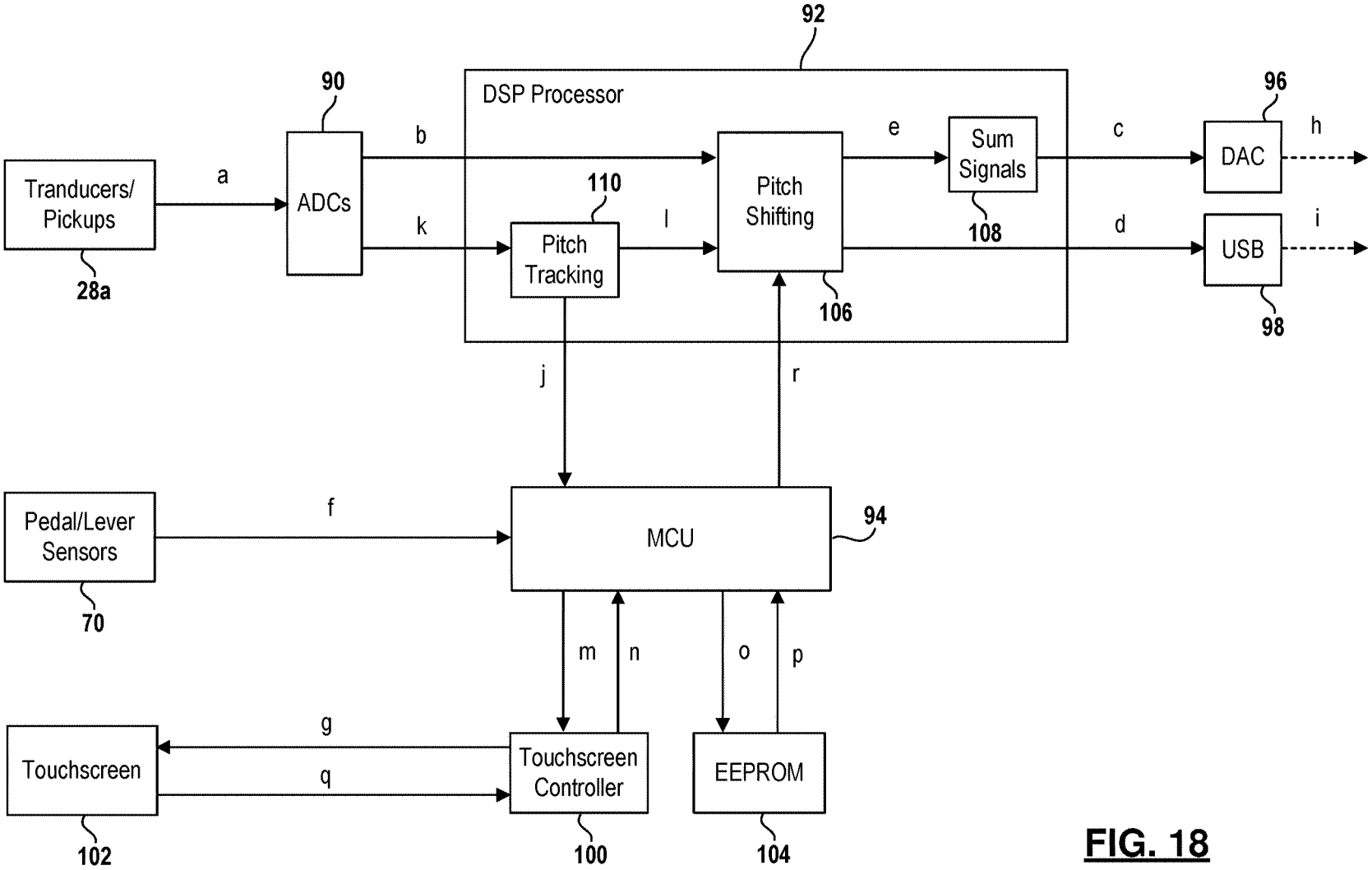

FIG. 18 is a block diagram of the software executed by a processor according to the present invention.

Figure 19:
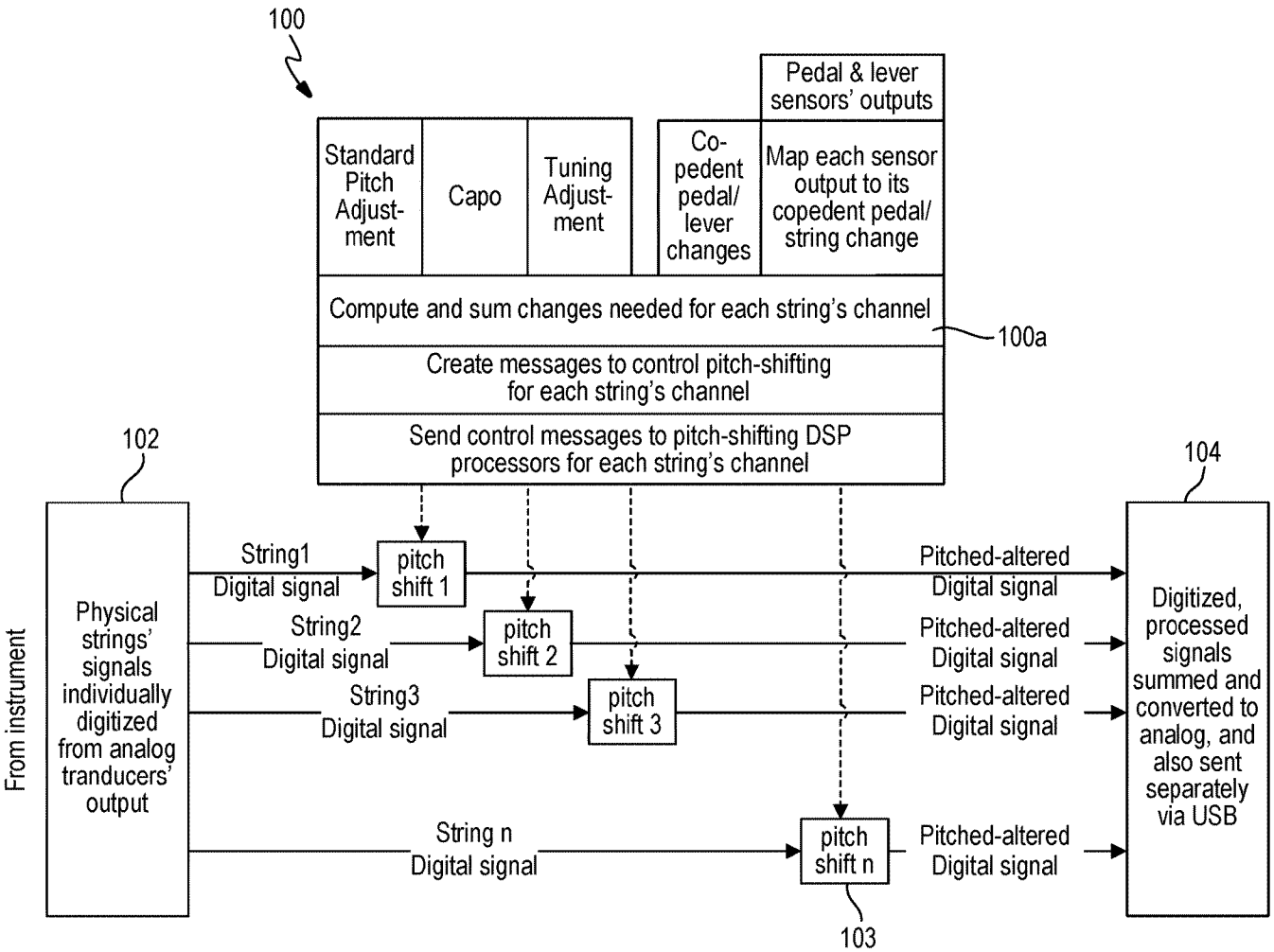

FIG. 19 shows the parts of the main control program used in calculating pitch change values and how the messages containing those values are sent to each channel's DSP in order to shift its pitch.

Figure 20:
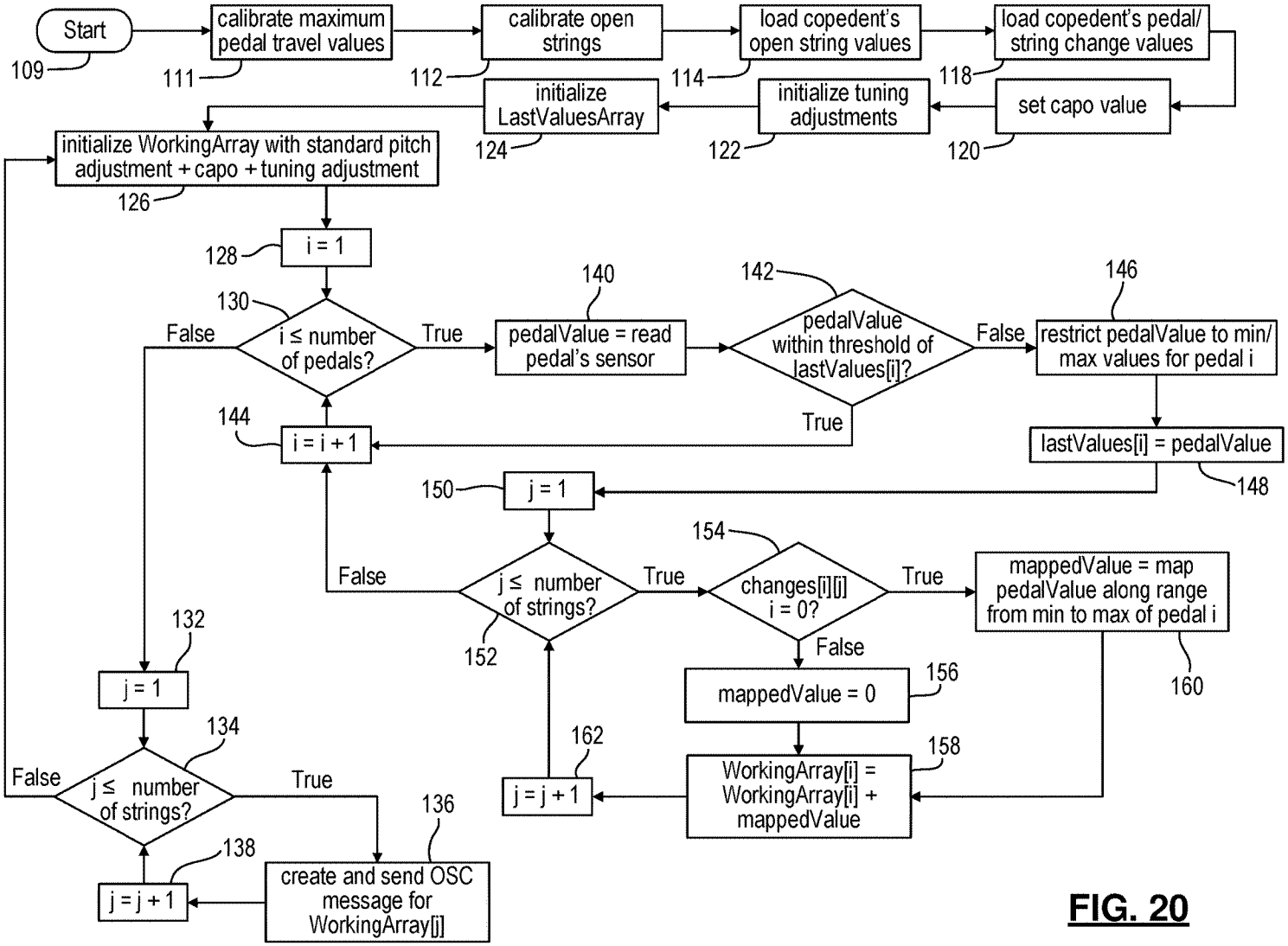

FIG. 20 is a software flowchart describing the main functioning of the main control program.

Figure 21:
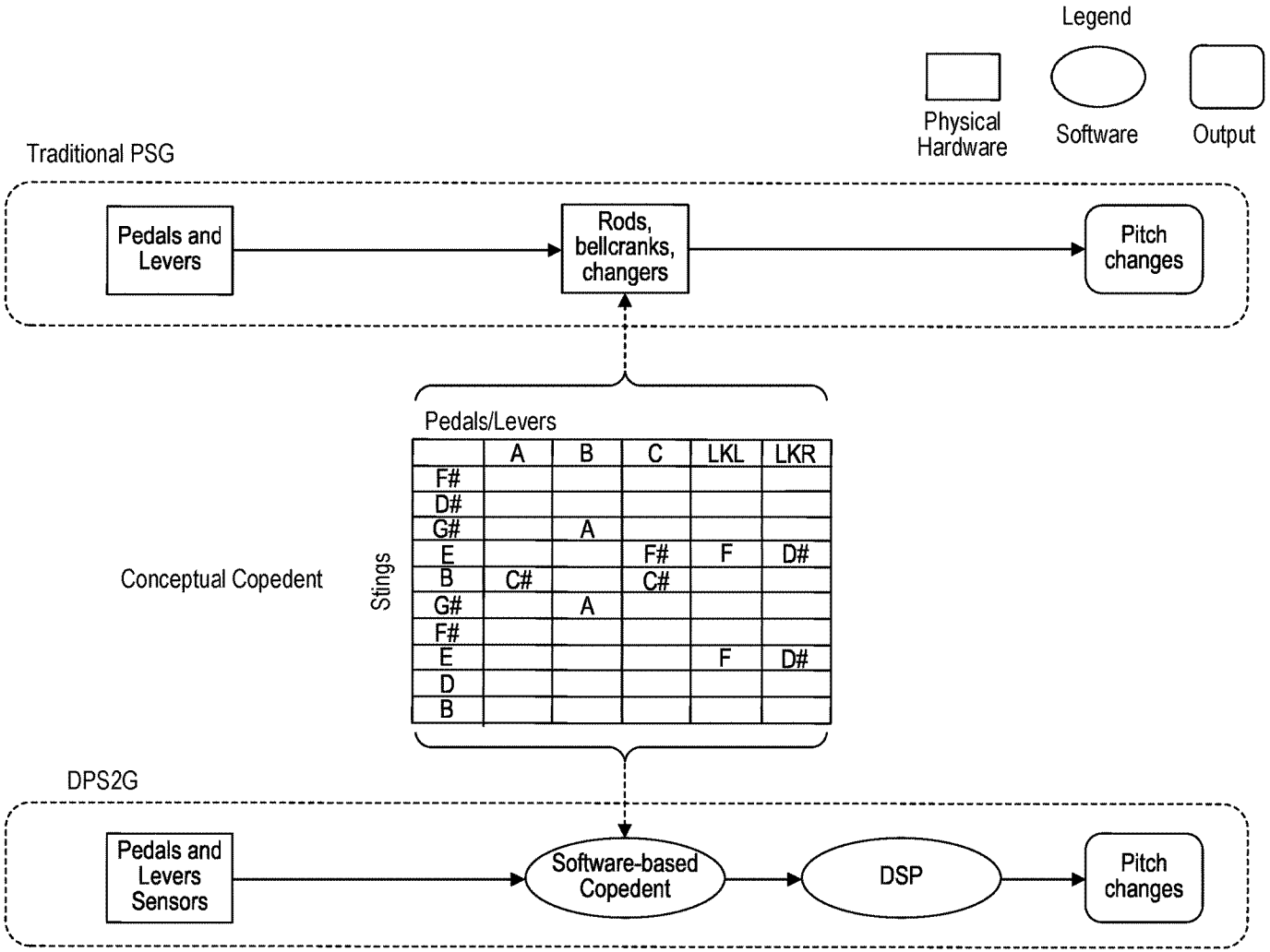

FIG. 21 gives an overview of how the concept of a copedent is realized in two different ways.

Figure 22:
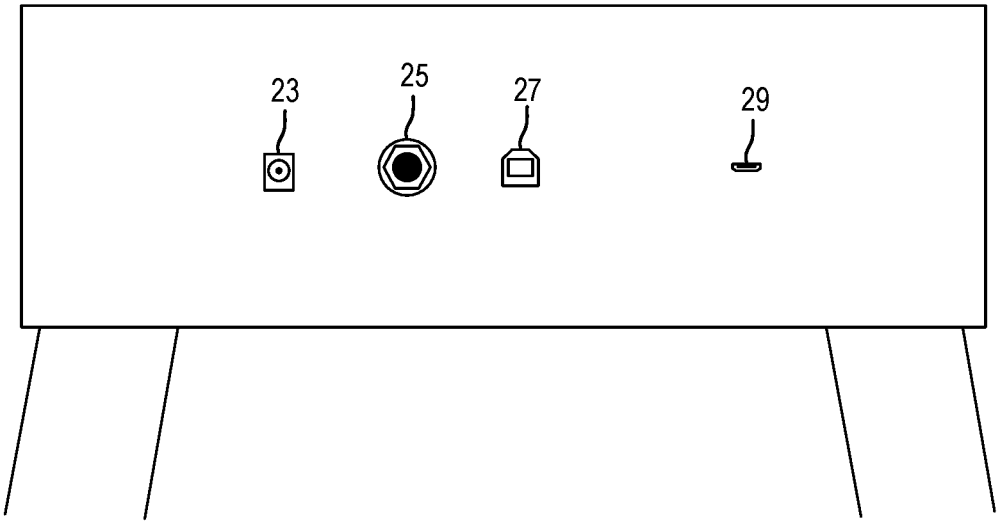

FIG. 22 shows an endplate of the instrument with its four jacks for connections to external devices.

DESCRIPTION OF THE PREFERRED EMBODIMENT

By outward appearance, the digitally pitch-shifted pedal steel guitar looks similar to a traditional instrument, however, there are numerous technical differences. Thus as seen in FIGS. 7A and 7B, the digitally pitch-shifted pedal steel guitar includes a body 10, legs 12, foot pedals 16 and knee levers 34. The strings 19 are stretched from tuning pegs 20 to bridge 22, across a multi-element pickup 28*a*.

However, unlike the traditional instrument, the foot pedals and knee levers are not mechanically coupled to cause physical stretching or loosening of the strings. Indeed, in the digitally pitch-shifted pedal steel guitar instrument the strings do not need to be physically stretched or loosened to change tunings. That is all done electronically and without the need to change string tension.

A touchscreen 102 is provided to allow the user to change settings within the instrument and thus change how the foot pedals and knee levers perform. The placement of the touchscreen 102 in FIG. 7B is merely exemplary. It can be located at any convenient position, such as on the top surface of the instrument near the neck, or in other suitable locations. Alternatively, the functionality of the touchscreen 102 can be implemented using an external touchscreen device, such as a smartphone or tablet computer communicating wirelessly with the electronics of the instrument.

Also, the multi-element pickup 28*a* is a more sophisticated pickup that can obtain pitch information from each string individually. One embodiment of a suitable pickup 28 is shown in FIG. 9. As illustrated, the pickup has separate (single-string) magnetic pickups. Thus the pickup can capture individual strings' vibrations separately. This aspect is discussed more fully below.

The digitally pitch-shifted pedal steel guitar provides a group of external connections, shown in FIG. 22. These include a power jack 23 to which a suitable power supply can be plugged to supply operating power for the unit. An analog audio output jack 25 supplies the analog output of the instrument. Jack 25 accepts a standard guitar cord by which the analog output of the instrument can be routed to a guitar amplifier. Also included is a USB output jack 27 and a USB input jack 29. The USB output jack 27 supplies digital audio signals from the instrument to a suitable outboard signal processor. This USB output can be used, for example, to route the digital audio for each string (individually, and/or collectively) to a digital mixing console or to a computer running mixing software. The USB jack 29 may be used to insert a memory stick or thumb drive, or to connect a computer, allowing the instrument to be programmed.

Pedals and Levers Operate Electronically, Yet Retain Familiar Feel

FIGS. 8A-8D illustrate one embodiment of attaching the pedals (or levers) in the digitally pitch-shifted pedal steel guitar. In this embodiment, the pedals and levers employ physical linkage rods 30 that couple to electronic Hall Effect sensors. The physical linkage rods 30 and associated mechanical linkage structures are designed to give the same feel as a traditional instrument when the player presses the pedal or lever. However, the manner of extracting control information from such operation of pedal and lever is entirely different. Instead of producing a change in string tension, as with conventional instruments, the digitally pitch-shifted pedal steel guitar converts physical motion of the linkage rod 30 into an electrical signal using a suitable transducer, such as a Hall Effect sensor.

Figure 8A:
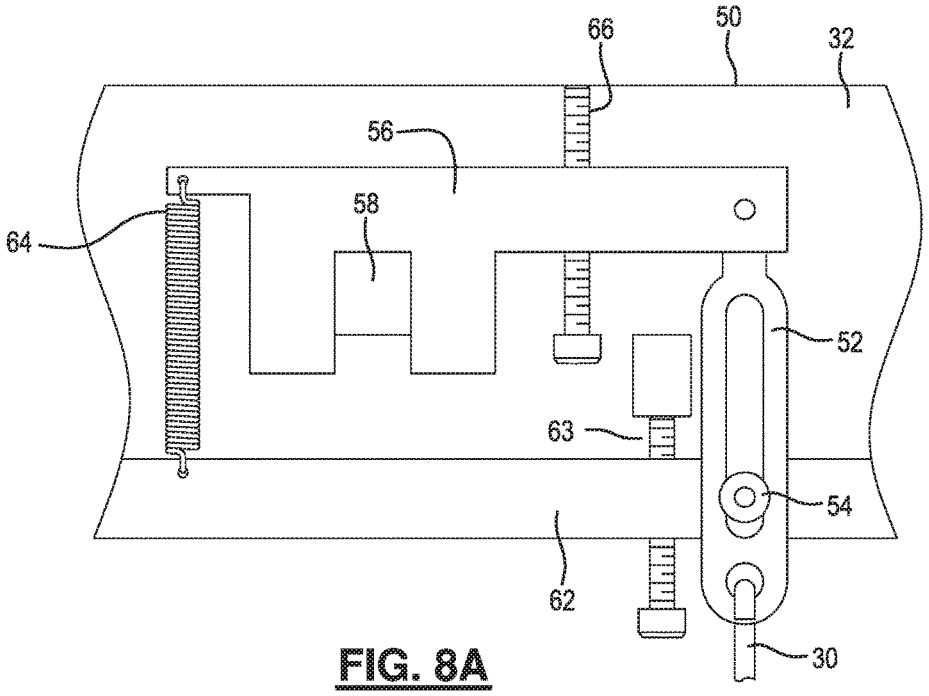

Referring to FIG. 8A, the front apron 32 of the digitally pitch-shifted pedal steel guitar is seen from inside the body or case, with the roof of the instrument's body (underneath and inside the body) being shown at 50. The pedal rod 30 attaches to a sliding plate 52 that is anchored by pin 54 secured to a rail 62 attached to the apron 32. The sliding plate 52 is in turn coupled to rocker 56 whose fulcrum is a cross rod 58 that transmits pedal movement to a bellcrank 60 (Shown in FIG. 8B). When the pedal is engaged, an adjustable travel stop screw 63 stops the rocker's travel. A rail 62, fashioned from a piece of wood, metal or other material serves as the mounting point for a spring, 64 that is biased to return the linkage assembly and the pedal rod to a point of rest. An adjustable travel stop screw 66 establishes the at rest position. Thus when the pedal is released, the spring 64 returns the rocker 56 to its at rest position, with the travel stop screw 66 contacting the underside 50 of the roof of the instrument's body 10.

Figure 8B:
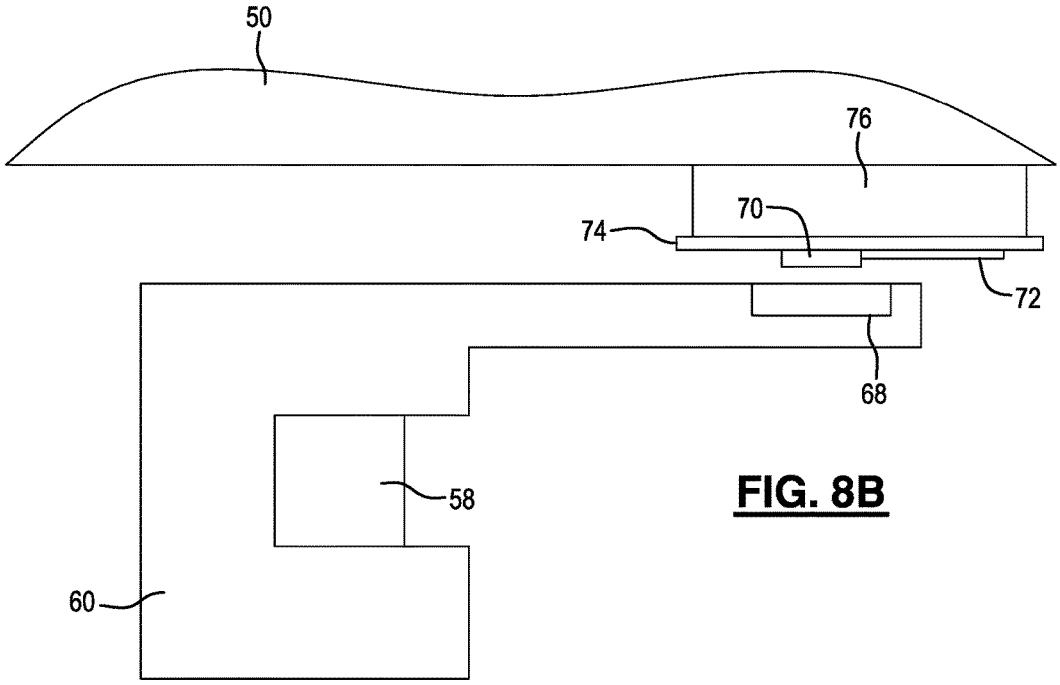

FIG. 8B, shows the bellcrank 60 mounted on cross rod 58. The bellcrank has an extended flange that carries a magnet 68, which can be press fit into the flange as shown. The magnet is situated across from a Hall Effect sensor 70. The Hall Effect sensor responds to the strength of the magnetic field of magnet 68 as it moves away from the sensor 70 when the pedal is depressed. The Hall Effect sensor produces an electrical signal that is carried by wires 72 to the electronic circuitry discussed below. The Hall Effect sensor may be mounted on a circuit board 74 supported by a spacer 76 secured to the underside of the instrument's body.

Figure 8C:
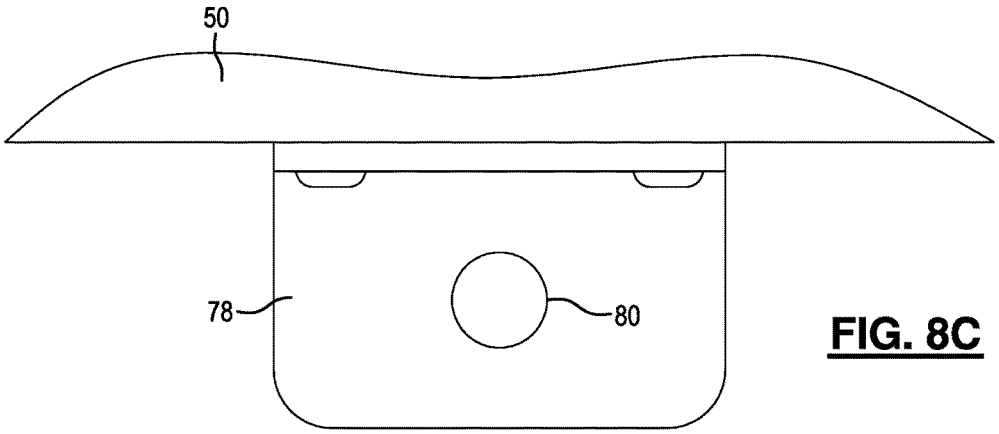
Figure 8D:
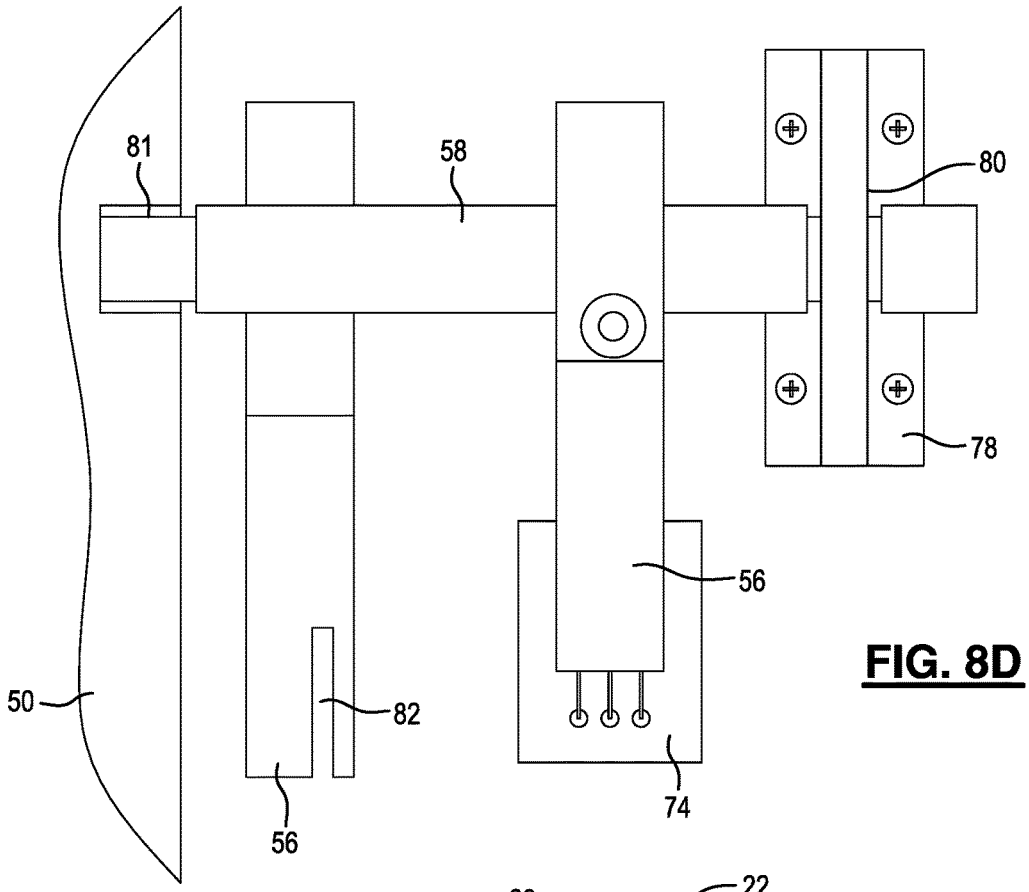

The manner of mounting the cross rod 58 to the roof of the instrument body 50 is shown in FIG. 8C. A cross rod mounting bracket 78 is attached to the instrument body 50 as with screws. The bracket includes a hole 80 from which the cross rod can pivot while secured to permit its movement in response to operation of the rocker. FIG. 8D, shows how the cross rod 58 is fashioned with a cylindrical end portion that can be fed through hole 80 to permit pivotal movement. The opposite end of cross rod 58 is similarly provided with a cylindrical end portion that is fitted into a hole drilled in the apron as at 81. In FIG. 8D, note that rocker 56 has a slotted portion at 82 to accept the sliding plate 52 (FIG. 8A).

Digital Signal Processing of Each Individual String

In the preferred embodiment of the digitally pitch-shifted pedal steel guitar, all strings are supported by a single bridge, as there is no need for independently moving bridges as in the case of a traditional instrument. As each string vibrates, its vibrations are captured by its associated pickup or transducer as one analog signal for each string. The analog signal for each string is transmitted through a cable connection to its associated ADC. Each separate channel of, now digital, audio signal will be acted upon by the pitch-shifting DSP processor downstream.

Referring to FIG. 17, a block diagram of a presently preferred hardware embodiment has been illustrated. Transducers within the pickup 28*a* capture and send analog signals (a) to separate analog to digital converters (ADCs) 90. Digital signals (b) output from the ADCs are received by the DSP processor(s) 92. Note: in the discussion here, the terms "DSP processor or DSP processor(s)" may refer to one or more DSP processors; that is, one or more processors may be used to handle the plurality of digital audio signals.

Meanwhile, output data (f) from the Hall Effect sensors 70 on each of the pedals and knee levers are read by the Microcontroller (MCU) 94. The MCU 94 calculates pitch shift values and sends them via messages (e) to the DSP processors 92. The DSP processors alter the pitches of the appropriate signal channels. The separate digital signals are summed and sent as a single digital signal (c) to the digital to analog converter (DAC) 96). Though that is what is shown in FIG. 17, alternatively, the digital signals may be sent to separate DACs and then summed in the analog realm.

From there, it can be output through a standard ¼" TS jack to an audio amplifier (not shown). In addition to the single summed output signal, the several digital signals are also sent separately (d) to a USB output port 98. The DSP processors can also send data (e.g., pitch tracking data, and pedal/knee lever travel data) (e) to the MCU for tuning and string calibration, and pedal knee lever sensor calibration.

The MCU communicates (h) with the touchscreen controller 100, which in turn communicates (g) with the touchscreen 102 to allow the user to interact with the main program running on the MCU. Saved copedent data is saved to and read from EEPROM 104.

Note: All components may be housed on the same circuit board or the system may be modularized with different components on different circuit boards connected by cables.

FIG. 18 is a block diagram of the hardware and software used in the preferred embodiment of the invention. As discussed above, transducers 28*a* capture the individual vibrating strings' signals (a) which are received by the analog to digital converters 90, one or more signals per DAC. The digitized signals (b) are then operated upon by a pitch shifting process 106, performed by the DSP processor(s) 92. As illustrated here, the pitch shifted data are then operated upon by a signal summing process 108, performed by the DSP processor(s), and the result (c) is fed to the DAC 96, as discussed above.

Also as discussed above, the output of the pitch shifting process 106 can be supplied in digital form (d) via a suitable interface, such as through a USB port 98. These digital domain signals can retain the data for each string as a separate digital channel, thus making it possible to process the data from each string separately and possibly in a different manner.

FIG. 18 shows in greater detail how the DSP processor(s) 92 and the MCU 94 communicate with one another. The DSP processor(s) implement a pitch tracking process 110 that operates on digital data from the ADC circuits 90. The MCU 94 is configured to receive pitch tracking data (j) and therefore has knowledge of what strings have been plucked, for the purpose of tuning and calibration. The MCU is also configured to communicate with the pitch shifting process 106, as illustrated. Thus the MCU, using information obtained from the touchscreen controller 100 and obtained from the EEPROM 104 along with changing pedal and knee lever travel data, determines what pitch shifting corrections need to be made to achieve a desired copedency.

FIG. 19 is a functional view of components and data that are used in the real-time realization of a copedent in one embodiment of the present invention. The separation of the individual strings' signals is emphasized. FIG. 19 explains how the digitally pitch-shifted pedal steel guitar achieves playability of a traditional instrument while greatly increasing functionality and capabilities.

In FIG. 19, the working memory of the main control program is shown at 100. That working memory holds the multiple inputs; variables, some of which are read from stored data, some of which change constantly as sensor data is read; calculations; and processes needed to create the messages that will be sent to the DSP processor(s). The row 100*a*, is the main work of the main control program. The messages, created and sent affect the individual string signals, which have been captured and converted to digital audio signals, as represented at 102 in FIG. 19. The pitches of each of the signals are altered independently, as required, based on the data encoded in the messages. In FIG. 19, the pitch shift for string n is shown at 103. Once pitch shifting is applied to all affected string signals, the data are converted back to analog, as shown at 104.

FIG. 20 illustrates how the main control program, operated by the MCU processor. The control program begins at start step 109. After tuning, calibration, and preparation (steps 111-124, the main processing begins by initializing the WorkingArray at step 126. It will be seen that step 126 represents the beginning node of an endless loop that begins with step 128 and returns following step 134.

At the start of this endless loop, the WorkingStringArray (an array of length equal to the number of strings) is initialized, each position in the array is loaded with the sum of the following values for the corresponding string:

1. The difference between the physical open string pitch and the copedent's virtual open string pitch
2. The value for the capo functionality
3. The value for tuning adjustment
4. The value for standard string pitch calibration These values are needed to achieve fully corrected and playable virtual open string pitches dictated by the copedent in effect.

After initialization of the WorkingStringArray, the Pedal/Lever Loop is entered at steps 128 and 130. For each pedal/lever, the corresponding sensor is read at step 140. If the sensor's output is within a threshold of the last value read for that sensor (step 142), the loop moves on to the next pedal/lever (step 144), since the pedal/lever must not have moved significantly. Otherwise, if the difference between the output value and the last value is larger than the threshold (at step142), then the value is checked to ensure that it fall within the range of the maximum and minimum values stored for that pedal/lever's travel (if the value is within a threshold of the maximum, it is set to that maximum value; if it is within a threshold value of the minimum, it is set to that minimum). Then, the last value for that string is updated with the newly read value.

Embedded within the Pedal/Lever Loop is the String Loop (beginning with step 150), which is concerned with adjusting the values held in the WorkingStringArray. In the String Loop, for each string, if there is no change dictated by the copedent for that string and pedal/lever combination (step 154), the mapped Value variable is set to zero at step 156. If there is a change dictated by the copedent for that string and pedal/lever combination, then the mapped Value variable is set, at step 160, to a value mapped from the point in the pedal/lever's minimum to maximum travel range into a range from zero to the number of semitones up or down dictated by the copedent for that pedal/lever and string combination.

The value of the mapped Value variable is then added, at step 158, to the value originally set in the WorkingStringArray at the beginning of the endless loop. This effectively sets a value that combines those summed values with the momentary pitch change calculated from the pedal/lever's travel.

The program proceeds to the next string in the loop, checks whether any change is dictated by the copedent for that string and pedal/lever combination, then sets the mapped Value variable to either zero or a mapped value, and adds it to the WorkingStringArray for that string.

By the time all pedal/levers and strings are considered by the two loops, the WorkingStringArray will contain one value for each string. Each value represents the sum of all variables needed by the DSP to shift the each string's channel's pitch for that moment in time.

With all the strings' values updated at the end of one iteration of the Pedal/Lever Loop, the main control program proceeds to a new, different loop, at steps 132 and 134. For each position in the WorkingStringArray, that is, for each string, the value in the WorkingStringArray is encoded into a message at step 136 containing the number of the string/channel and the value in the array (in the preferred embodiment, the Open Sound Control protocol is used for encoding and decoding these messages). The message, sent via some standard communication protocol capable of addressing multiple peripherals (such as SPI), is sent to the DSP processor handling that particular channel. The DSP processor decodes the message and adjusts the current pitch of the particular channel addressed in the message, by the amount sent in the message.

Processing then returns to the main endless loop at step 126 where the WorkingStringArray is refreshed and the Pedal/Lever Loop is entered.

For a more complete understanding of how the digital pedal steel guitar may be implemented, computer code excerpts and a pseudocode description is provided at the end of the disclosure. Included with these code excerpts is a description of the variables, functions and code used by the main control loop.

Discussion of How Copedents Work

To understand how the digitally pitch-shifted pedal steel guitar instrument affects different tunings, an understanding of copedents will be helpful.

As described in FIG. 6 Standard E9 Copedent, a copedent is usually depicted as a table with rows representing strings and columns representing pedals and knee levers. The intersection of each row and each column (table cell) represents the change made to that string's pitch by engaging that particular pedal or knee lever. The pitches, with note names and octave numbers, to which the strings are tuned when "open" (i.e., without fretting), one per cell, are shown in the leftmost column, with string 1 furthest from the player and string 10 closest to the player as he sits at the instrument.

The conventional names for pedals are as follows. For a standard E9 copedent, shown in FIG. 6, pedals are named A, B, and C, from left to right, from the point of view of a player sitting at the instrument. The pedals and knee levers, by conventional name, appear along the top header row. The knee levers are named in the following manner: left knee left (LKL), (where the left knee engages the lever by pressing to the left), left knee right (LKR), right knee left (RKL), and right knee right (RKR).

In the cells at the intersections of strings (rows) and pedals/levers (columns), the number of half-steps that particular pedal/lever should raise or lower the pitch of that particular string and/or the actual pitch name achieved by engaging the pedal/lever.

If a cell is empty, the pedal or lever does not affect that string. If a pedal or lever does affect a string, there are two commonly used ways of denoting that fact in a copedent: either the note name of the altered pitch is written in the cell or the number of semitones up or down is written in the cell. Therefore, if a cell contains a note name, the string will move up or down to that note's pitch. Alternatively, if a cell contains a signed numeral or one or more plus signs or negative signs, for example, +2 or −1 or (++ or −), the string will move up or down that number of semitones. Sometimes, both are used, e.g., "++A." Note that, in the particular copedent illustrated in FIG. 6, RKR has a "half-stop" when lowering string 2.

A copedent is realized in a traditional pedal steel guitar in the physical realm by mechanical means (i.e., rods and bellcranks and changers, aka "machinery"). As the machinery is engaged via pedals/levers, the tension and pitch of one or more strings affected by a pedal/lever will change. Each string will change continuously up to or down to the pitch shown in the cell of the copedent table where that string and pedal, or lever, intersect. Note that FIG. 6 shows only one example copedent. There exist several standard copedents and many, personal variations of them: many pedal steel guitars have a different number of pedals or knee levers; some knee levers are engaged vertically; some pedal steel guitars have multiple necks; open strings can be tuned differently; changes per pedal/lever can be different; some pedal steel guitars have a different number of strings on each neck. Also note that in some other copedents, e.g., the standard C6 copedent, pedals are conventionally named by number, e.g., "Pedal 4," "Pedal 5," etc.

By contrast, the digitally pitch-shifted pedal steel guitar realizes copedents in electronic hardware and software. As pedals/levers are engaged, the software receives data from sensors about the pedals' and knee levers' movements. It uses those data in conjunction with the software copedent currently in force to calculate values to be used to control real-time digital signal processing (DSP), and sends these values to the processors to accomplish that processing.

This transfer of copedents from the physical realm to the software realm further allows copedents to be created, edited, saved, and recalled, and allows copedents which are impossible to realize in the traditional pedal steel guitar. For example, in the traditional pedal steel guitar pitch change intervals are always limited by how far a string could be tightened before breaking or loosened before losing its tone. Another limit of the traditional pedal steel guitar is the number of strings that might be changed with one pedal or knee lever, since the resistance of strings or return springs is cumulative. And so, more generally, the present invention is a novel method of easily implementing and changing an essentially infinite number of copedents.

In the digitally pitch-shifted pedal steel guitar, the machinery of a traditional pedal steel guitar is replaced by a system of electronic components including sensors, audio ADC and DAC, DSP, and control processor (e.g., a microprocessor), along with software in both the DSP and control realms. It is this control realm of software (copedent-related user interface and control) that is the present invention.

FIG. 21 shows how the copedent, as a logical entity, is realized physically in the traditional pedal steel guitar (upper dotted lined area) as compared with how it is realized in software and electronic hardware (lower dotted lined area). The legend explains what portions of the realizations are physical manifestations and which are software-based. As seen in FIG. 21, in the traditional instrument copedents are realized using physical rods, bell cranks and changers. In the digitally pitch-shifted instrument of the present disclosure, pitch changes are effected by digital signal processing of data obtained from individual string sensors. In the conventional instrument, pedals and levers control the physical rods, bell cranks and changes. In the digitally pitch-shifted instrument, the pedals and levers are coupled to sensors which electrically control the digital signal processing.

User Interface of the Digitally Pitch-Shifted Pedal Steel Guitar

The processor(s) of the digitally pitch-shifted pedal steel guitar operate in accordance with a main control program, the details of which are discussed below. In the preferred embodiment, the main control program presents a user interface through which a user/player may enter data and adjust various aspects of the instrument and the main control program. If desired, the user interface can be displayed upon an LCD display panel mounted to the surface of the instrument. Alternatively, the user interface can be displayed upon a separate device, such as via an app running on a tablet display device (e.g., iPad) or smartphone. To give a flavor of the types of things the user can do via the user interface, the following examples are provided. It will be appreciated that a variety of features can be implemented on the digitally pitch-shifted pedal steel guitar, and the following examples are not intended to be exhaustive.

Manipulating Copedents

With regards to copedents, as described earlier, the user may enter data to create new copedents or make changes to existing copedents. That is, through the user interface, the user/player may recall, delete, edit, save, and use in playing, any number of virtual copedents. Therefore, through the user interface, the user is able to program the "virtual open string" pitches as well as to program the individual pedal and lever changes to each string's output pitch.

The way different pedals/levers interact when engaged simultaneously, e.g., "splits" and "meta-splits" as well as "half-pedals" (including "multiple stop half-pedals" and "multidirectional half-pedals" can be programmed as well through the user interface.

The user interface is also used to make other musical adjustments to the instrument such as:

1. small tuning adjustments to all strings or to one or more strings individually
2. a "virtual capo" to bring all strings up or down equally.

In a traditional pedal steel guitar, in order to change copedents, the musician needs to make physical changes and/or adjustments to pedals, rods, changers and may even need to change the gauge of strings used.

In contrast, in the present disclosure, through the use of a menu, the user is able to switch between saved copedents quickly. Alternatively, "banks" may be used. Each bank displays multiple saved copedents and the user can switch through different banks (FIG. 16). Thus, a large number of copedents is available to the musician at any time while playing. The musician can switch copedents even during the performance a single piece of music.

Again, copedent changes in the present invention may be more complex than in the case of the traditional pedal steel guitar in that they may include pitch change intervals impossible to achieve through string tension changes, priority and additive splits, meta-splits, and multi-position and multidirectional half-pedals.

In this embodiment of the present invention, the user interface is described in some detail here:

A user is presented with several options, including but not limited to:

Physical open string tuning
Physical open string calibration
Pedal/knee lever (sensor) calibration
Capoing
Fine tuning adjustment
Creating, editing, saving, recalling, and using copedents Choosing to tune the physical open strings, when the user selects the corresponding item from the menu, the software is put in a mode which waits for input from the separate transducers. As the strings are plucked, the actual pitches of the strings sounded are tracked and displayed on the UI (FIG. 14). The user mechanically tunes each physical string by means of a tuning mechanism (20) seen in FIG. 7 to achieve the desired physical open string pitch. This is essentially the same process as tuning any electric stringed instrument with an electronic tuner. When the strings have been tuned this way, the physical strings' pitches will be close to some standard pitch. And, as in any traditional pedal steel guitar or guitar, the combination of string gauge and tension will provide to the player the proper and familiar feel when the string is picked and barred.

Another aspect of the UI is the option to calibrate open string pitches to standard tuning. After the user tunes the physical strings, this mode can be used to make automatic adjustments to the virtual open string pitches so that they each remain precisely at the copedent's intended pitch even if the physical string goes slightly out of tune over time or while playing. In this mode, the software precisely compares the actual physical string pitch with the pitch to which the user tuned the physical string. If the string has loosened slightly and is, for example 4 cents flat from the intended physical open string pitch, then enough pitch correction will be added to the workings of the main program. If another string is slightly sharp, its channel can be compensated independently and differently during the playing of the instrument as the main program calculates all DSP control. That is to say, these values will be used as a starting point for all pitch-shifting calculations during the continuous processing to control the DSP pitch-shifting during the playing of the instrument.

Sensor Calibration

Should sensors be employed on pedals and knee levers that from time to time require recalibration of the beginning and ending points of their range of motion, the user, choosing to calibrate pedal/lever travel, selects the corresponding item from the menu. The software is thereby put in a mode which waits for input from the engaging of pedals and knee levers (FIG. 10). When a pedal/lever is engaged, the processor notes which pedal/lever has moved and by how much. As the user takes it through the full range of its motion, the processor tracks the maximum and minimum values given by the sensor. Averages of several of these maximum and minimum values are taken for each pedal/lever and saved in memory. These values are also among those which will be used during the continuous processing by the main control program to control the DSP pitch-shifting during the playing of the instrument.

Setting Up a Capo

Choosing to set a capo value, the user selects the corresponding item from the menu. The software is thereby put in a mode which waits for input from the user in the form of a positive or negative integer value, which will be used as the number of semitones up or down from the virtual open string pitches (FIG. 11). This value is also among those used during the continuous processing to control the DSP pitch-shifting during the playing of the instrument. All strings' pitches will be essentially transposed by this amount during playing.

Making Fine Tuning Adjustments

Choosing to make a fine tuning adjustment (for example, in order to be in tune while playing with others who are not necessarily tuned to standard A440), the user selects the corresponding item from the menu. The software is thereby put in a mode which waits for input from the user in the form of some pitch adjustment; e.g., cents up or down (FIG. 12). This value will also be used in calculations by the main control program during the continuous processing to control the DSP pitch-shifting during the playing of the instrument.

Copedents

Choosing to recall an existing, stored copedent and use it to play, the user can choose from a menu or scroll list of copedents stored in non-volatile memory. Then, choosing to "Play" (FIG. 13), the chosen copedent is used by the main control program to calculate virtual open string pitches and pedal/lever-altered pitches.

Choosing to create a new copedent, the user can choose an existing, stored copedent that is similar to the copedent desired from a menu or scroll list of copedents stored in non-volatile memory. The user can then edit the values of this copedent and save it as a new copedent (FIG. 15).

To edit a virtual open string pitch, the user touches the open string value in the left column. This presents a slider, much like the one used for capo editing, which can be used to raise or lower the pitch of the virtual open string.

To edit a pedal/lever change, the user touches a "cell" (the intersection between a string's row and pedal or lever's column). This presents a slider, much like the one used for capo editing, which can be used to raise or lower the pitch of that particular string to be achieved when engaging the pedal or lever.

Once all changes are made, the user can touch the "Save" button so that the newly created copedent can be stored in non-volatile memory for later recall and use. Alternatively, the user can touch the "Cancel" button to discard any changes made.

Saving Copedents for Later Recall

Once copedents are saved, they may be grouped in a "bank" of several copedents to afford quick changes which might be used during a performance. While playing, a screen like that seen in FIG. 16 is displayed. The user may at any time touch the "button" for any of the copedents available in the bank, at which time the copedent will be swapped into working memory. From that point on (until another change is made), the newly chosen copedent will determine the virtual open string pitches and the pedal/lever changes as the user plays the instrument.

Control Program of the Digitally Pitch-Shifted Pedal Steel Guitar

As seen in FIG. 18, the DSP processor (92) has three main functions: pitch-tracking (110), pitch-shifting (106) and summing pitch-shifted digital signals (108). The applications of these functions are illustrated below by describing the use of the software.

In "string calibration" or "tuning" mode, the digital audio signals (k) are received by the pitch-tracking function 110. Pitch-tracking data (j) are sent to the micro-controller (MCU) (10) via some kind of serial message (e.g., MIDI, Open Sound Control, etc.). These data are ultimately displayed to the user by being sent as flat, sharp, or in-tune note information (m) to the touchscreen controller 100 which is in charge of communicating to the touchscreen 102 via (g). The user can tune the physical open strings until the touchscreen indicates that the pitches coming into the pitch-tracking function are in tune.

In "pedal calibration" mode, as the user engages the pedals and levers, the minimum and maximum values of the sensors (70), corresponding to the at-rest position and the fully engaged position of the pedals and levers, are sent (f) to the MCU. The MCU saves these position data in memory, also sending them (o) via some serial protocol (e.g., SPI, I2C, I2S, etc.) to EEPROM (104) for longer-term storage, so that upon the next restart, the previous calibration values can be read (p) and reused.

In "edit" mode, the user interacts with the touchscreen (102). User touch data (q) is sent to the touchscreen controller (100) which translates as necessary and sends that data (n) to the MCU. The MCU will record the user's changes and send the data (o) to EEPROM for longer-term storage. This data includes copedent values, virtual capo values, and virtual tuning adjustments.

In "copedent" recall mode, the user again interacts with the touchscreen by requesting to recall a copedent from EEPROM. The request through (q) and (n) is managed by the MCU and the data is loaded from EEPROM via (p) into the MCU's memory.

In "play" mode, the transducers (28a) send their analog signals (a) (of strings played open or fretted/barred) to the ADCs (90). The digital output signals (k) are received by the DSP processors' pitch-tracking function (110). The DSP processors' pitch-shifting function (106) receives the pitch tracking data (I) along with the actual digital audio signals (b) themselves.

As the player engages the pedals and levers, the MCU, based on the copedent currently in effect, and on incoming pedal and lever sensor data (f), calculates the amount of pitch-shifting necessary for each channel. The results of those calculations are sent along with their corresponding channel, encapsulated in messages (e.g., MIDI, Open Sound Control, etc.) via (r) to the pitch-shifting function (106) in the DSP processor. The pitch-shifting function, in real-time, alters the digital audio signals which are then sent:

1) via (e) to a function that sums the signals into one digital signal (c) which is then sent to a digital to analog converter (DAC) (96). The output of this DAC (h) is output to a standard ¼" guitar plug. This can be, for example, amplified by a standard guitar or pedal steel guitar amplifier.
2) via (d) to a module or function (98) to encapsulate the separate channels' signals using a USB protocol for audio. This output (i) can be used downstream (e.g., for input into an audio interface, for recording, for effects, etc.)

Note: All components may be housed on the same circuit board or the system may be modularized with different components on different circuit boards connected by cables.

Terms Used in This Document

As used herein,

"Pedal Steel Guitar (PSG)" refers to an instrument which normally comprises a body with one or more necks of strings, supported by legs, and with pedals and knee levers, normally played by picking the strings and fretting or stopping the strings with a bar and by engaging the pedals and knee levers which alter the strings' pitches.

"Traditional Pedal Steel Guitar (TPSG)" refers to a pedal steel guitar, developed since about the middle of the $20^{th}$ century which alters its strings' pitches by means of the physical stretching and loosening of the strings.

"Pedal" is used to refer to either a pedal or lever used to alter the pitch sounded by one or more strings.

"Copedent" refers to the concept comprising two kinds of musical information: the pitches of the open (i.e., unfretted/unstopped and therefore unaltered) strings of a pedal steel guitar; and a description of what pitch changes are made to one or more strings by the engaging of each pedal. Also often referred to as "setup."

"Machinery" refers to the mechanical components housed on the underside and at the bridge end of the body of a traditional pedal steel guitar. "Machinery" includes metal cross rods, bellcranks, pull rods, springs, "roller nut" (a traditional pedal steel guitar nut has one roller per string so that changes in string tension can be evenly and continuously distributed over the entire length of the string, eliminating hysteresis to some degree), "bridge," one for each string, which rolls in the direction of the nut (loosening the string) or away from it (tightening the string), and "changers" (assemblies of "fingers" or sliding levers which affect the movement of the bridges).

"Digitally Pitch-Shifted Pedal Steel Guitar (DPS2G)" refers to a pedal steel guitar in which the present disclosure would replace the machinery of a traditional pedal steel guitar such that the resulting pedal steel guitar would sound precisely the way a traditional pedal steel guitar sounds and would be played by the musician in precisely the same way as a traditional pedal steel guitar is played. However, the DPS2G would employ this novel method for the controlled altering of string pitches.

"Analog to Digital Converter" or "ADC" is an electronic processor or system that converts an analog signal to a digital signal.

"Digital to Analog Converter" or "DAC" is an electronic processor or system that converts a digital signal to an analog signal.

"Micro-controller" or "MCU" is a small computer, often with input/output connections for acquiring or sending data or signals, usually running on a small integrated circuit.

"Printed Circuit Board" or "PCB" refers to a board made of an insulating substrate with etched electrically conductive tracks and pads to support and connect electronic components.

"DSP" means digital signal processing. Though other kinds of signal processing are possible, the present disclosure employs DSP for the purpose of the controlled shifting of musical pitches.

"User" refers generally to the player of the instrument since it is assumed that the player will also be the person interacting with the DPS2G's software by means of its user interface.

"User Interface" refers to a method that affords a user to ability to recall, edit, store, and switch between different copedents or "setups" as well as make other alterations such as slight adjustments to the virtual tuning of different strings, capo all strings up or down a specified amount, etc.

"Physical open string" refers to a physical string that is neither barred/fretted nor altered by a pedal or lever and whose frequency is the input to a transducer.

"Virtual open string" refers to the pitch of the string when neither barred/fretted nor altered with a pedal but whose signal has passed through the pitch-shifting processor. Based on the virtual copedent (see below), in effect the virtual open string pitch may be different from the physical open string pitch.

"Virtual copedent" is like a copedent (see above) but comprises virtual open string pitches along with pedal/lever changes that might alter the pitch further.

"Crosstalk" is the unintended capture by a pickup or transducer of an adjacent or nearby string's signal.

"Tablature" refers to a somewhat standardized notation used by pedal steel guitar players of what is played on a pedal steel guitar and how; that is, a way to notate which strings are played at which frets with which pedals and knee levers engaged.

"Tabbing" refers to the act of recording in tablature what is played on a pedal steel guitar.

"User" and "Player" and "Musician" are used interchangeably.

Pseudocode:

This pseudocode assumes a touchscreen user interface and a micro-controller with two functions:

1. control of the touchscreen user interface
2. the main control program, the "brains" of the pedal steel computation which entails: taking as input pedal and knee lever sensor output, using those to compute pitch-shifting control values, and sending those values encoded in messages to the one or more DSP processors.

This pseudocode does not go into detail on other aspects of the program having to do with calibration and editing copedents and interfacing with other external devices and data. Rather it concentrates on just that data acquisition, computation, and messaging which is the present disclosure, the realization in software of a pedal steel guitar copedent for use in a digitally pitch-shifted pedal steel guitar.

The code has two main modes: UI (in which the user can interface with the touchscreen and through it, the system) and PLAY (in which the user can play the instrument with all values in effect).

The main loop checks the mode. If it is PLAY, the controller takes input and computes pitch-shifting values and sends messages to the processors. If the mode is UI, the code controls the touchscreen, sending values to and receiving values from the user, reading and writing values to EEPROM, etc.

The code assumes that the physical open strings have already been tuned by the user to certain prescribed pitches.

Note: Values for pitch adjustments are presented to the user in the user interface as either multiples of semitones or as cents, depending on what musicians generally expect (e.g., as semitones when thinking about non-microtonal open string pitches, capo values, and pedal/lever changes and as cents when "tweaking" the tuning of the instrument). When used in the actual code for calculations, all values are converted to either one or the other.

Other modes are possible. For example:

1. UTILS: mode: wherein the software allows the user to access utilities used by the software and hardware; e.g., running diagnostic tests.
2. SHARE mode: wherein the software, via an external connection, e.g., USB, can export or import saved copedent data as a file for sharing among users.
3. TAB mode: wherein the software, via an external connection, e.g., USB, can output all data necessary for an external device running external software to translate said data into standard pedal steel guitar tablature in real time.

Variables

Note: values for those variables listed here may be set at different locations in the code, but their scope is global)

StandardPitchAdjustmentArray: array to hold the number of cents up (positive) or down (negative) to adjust each physical open strings' pitches to reach a standard pitch CapoValue: value in semitones up or down TuningAdjustmentValue: value to hold the number of cents up or down to adjust the entire tuning of all strings to a tuning different from standard pitch (e.g., for the purpose of being in tune with other instruments)

WorkingArray: array to accumulate up all values (for each string, during each iteration of the main loop) that go into the calculation of the pitch-shift value to be sent to the DSP PedalMinArray: array to hold the average minimum value corresponding to the output of a sensor on a pedal or knee lever at rest PedalMaxArray: array to hold the average maximum value corresponding to the output of a sensor on a pedal or knee lever at its fully engaged position LastValueArray: array to hold the last read sensor value for each pedal/lever so newly read values can be compared for incremental changes PedalChangeThreshold: value (expressed as a percentage) used to determine if a sensor output value has changed enough since the last time it was read to warrant further computation PedalMinMaxThreshold: a value (expressed as a percentage) used to determine if a sensor output value is within a certain range of a PedalMinArray or PedalMaxArray value CopedentOpenStringDifferentialArray: array to hold values in semitones up or down needed to adjust the physical open strings' pitches to reach the virtual open strings' pitches needed for the copedent CopedentPedalStringChangesArray: two-dimensional array to hold values in semitones up or down which each pedal/knee lever will change each string's pitch Copedent: struct or object which holds values for virtual open strings' pitches and a CopedentPedalStringChangesArray CurrentCopedent: a Copedent struct or object which is the copedent currently being used in playing the instrument CALIBRATIONS (via user interaction):

```
CalibratePedalSensors
        /*** Set PedalMinArray and PedalMaxArray values ***/
        /* User puts system into CalibratePedalSensors mode.
         * Then, as the user engages each pedal and lever several times
         * in turn, the min and max output values from sensors
         * are read. The average min and max for each pedal/lever
         * are stored in the PedalMinArray and PedalMaxArray.
         */
CalibrateOpenStrings
        /*** Set StandardPitchAdjustmentArray values ***/
        /* User puts system into CalibrateOpenStrings mode.
         * Then, as the user picks each string the pitch is tracked and
         * compared against the standard A440-based pitch intended for
         * that physical string. The differences are calculated and stored
         * in the StandardPitchAdjustmentArray.
         */
```

SET-UP (available via user interaction):

```
EditSaveCopedent
        /*** Alter existing copedent and save as a new user-defined
        copedent ***/
        /* User puts system into EditSaveCopedent mode.
         * Then, via the touchscreen display, the user changes virtual
         * open string pitch values and then the desired pitch changes
         * to be achieved when each pedal/lever is engaged.
         * The newly edited copedent can then be saved.
         */
LoadCopedent
        /*** Recall user-defined copedent and load into memory for
        use ***/
        /* User recalls a saved copedent to be loaded by the system.
         * This sets the CopedentOpenStringDifferentialArray with values
         * arrived at by comparing the physical open string pitches and
         * the recalled copedent's virtual open string pitches.
         */
SetCapoValue
        /*** Adjust tuning of strings with a virtual capo ***/
        /* User enters a number semitones to which virtual open-tuned
         * string pitches should be shifted. Zero is no shift. A positive
         * number is an upward pitch shift, a negative number is
         downward.
         * The value is stored in the variable CapoValue.
         * This value is used for all strings.
         */
SetTuningAdjustmentValue
        /*** Adjust tuning of strings in cents ***/
        /* User enters a number of cents by which virtual open tuned
         * string pitches should be shifted. Zero is no shift. A positive
         * number of cents is an upward pitch shift, a negative number
         * is downward. This value is stored in the variable
         TuningAdjustmentValue.
         * This value is used for all strings.
         */
```

Pseudocode of Main Copedent and Control

```
/** Initialize LastValueArray **/
FOR pedal = 1 to NumberOfPedals
    SET LastValueArray[pedal] = 0
END FOR
```

Endless Loop:

```
/** Initialize WorkingArray **/
FOR string = 1 to NumberOfStrings
    WorkingArray[string] = CapoValue + TuningAdjustmentValue +
        StandardPitchAdjustmentArray[string]
END FOR
FOR pedal = 1 to NumberOfPedals
    inValue = READ pedal sensor
    // If sensor value has not changed (that is, pedal/lever
    // has not moved enough to warrant a change, do nothing.
    // Otherwise, check, store, and use
    IF absoluteValue( inValue - LastValueArray[pedal] ) >
PedalChangeThreshold
        // If value is near min or max of pedal/lever travel range,
        // force value to the limit (min or max) of that range
        IF inValue is within threshold range of PedalMinArray[pedal]
            inValue = PedalMinArray[pedal]
        END IF
        IF inValue is within threshold range of PedalMaxArray[pedal]
            inValue = PedalMaxArray[pedal]
        END IF
        // Store as last value for comparisons against future readings
        LastValueArray[pedal] = inValue
        // If a pedal affects a string, compute and send
        // pitch adjustment value to DSP
        FOR string = 1 to NumberOfStrings
            // If a change is required by the copedent for
            // the particular combination of pedal and string ...
            IF CopedentPedalStringChangesArray[pedal][string] != 0
```

-continued

```
                    // map inValue into the range from the pedal's
minimum
                    // maximum values
                    SET mappedValue = (
                        (inValue − PedalMinArray[pedal]) *
    (CopedentPedalStringChangesArray[string][pedal]) /
                        (PedalMaxArray[pedal] − PedalMinArray[pedal])
                        )
                ELSE
                    SET mappedValue = 0
                END IF
                SET WorkingArray[string] =
                        WorkingArrayString[string] + mappedValue
            END FOR
        END IF
    END FOR
    // Once all values are calculated, send control messages to DSP processor(s)
    FOR string = 1 to NumberOfStrings
        value = WorkingArray[string]
        dspControlValue = convert(value) **
        Send control message to DSP with string and dspControlValue
    END FOR
END loop
** Value needed by DSP algorithm to shift pitch of digitized string's signal
```

Copedent Realizations

FIG. 21 gives an overview of how the concept of a copedent is realized in two different ways.

A typical E9 copedent is shown in the center of the figure, labelled "Conceptual Copedent."

Above the copedent table, the figure shows how, in the case of the traditional pedal steel guitar, that copedent is realized in the physical realm by means of physical machinery; i.e., rods, bellcranks, changers, etc. In the traditional pedal steel guitar, the actual pitch changes are realized by using the physical machinery to physically stretch and loosen strings.

Below the copedent table, the figure shows how, in the case of the present disclosure, the copedent is realized by means of software and the pitch changes are realized by signal processing which is controlled by the copedent software.

FIG. 22 is a side view of the right endplate of the preferred embodiment of the present digital pedal steel guitar which shows the placement of four connectors used to interface the instrument with external devices and power.

a. End plate
b. Legs
c. Barrel connector jack to connect an AC to DC power adapter
d. ¼" guitar jack
e. Type B USB jack
f. Micro USB jack In the preferred embodiment, housed in the right end plate (a) of the instrument is a standard barrel connector (23), e.g., 9.5 mm length, is used to accept DC power, e.g., from a standard wall adapter. This is used to power the active pickups and all electronics: the MCU, the sensors, the processors, and the ADCs and DAC, etc.

Also housed in the endplate is a standard ¼" jack (25) to be used for the summed analog audio output for amplification or recording.

Also housed in the endplate is a Type-B USB jack (27) to output separate digital audio channels (one for each string, after processing) for any use, e.g., post-processing or recording.

The USB out can also carry other data sent by the MCU. For example, pedal and knee lever position data, current copedent data, physical open string pitch data, and virtual open string pitch data may be sent to a personal computer or other external device running software. One example of such software is a real-time auto-tablature program. In this case, after starting the program on the external device and software handshaking occurs between the that program and the MCU, as the player plays the instrument, this data can be used to determine the nearest fret at which strings are barred/fretted and which pedals and knee leers are engaged. This data can be used to create tablature for the pedal steel guitar.

The Micro USB jack (29) can be used to upgrade firmware on the MCU and DSP processor(s). It can also be used by an external program to download and upload saved copedents, e.g., for use in sharing between musicians.

OTHER EMBODIMENTS

A further embodiment of the present invention may use only one DSP processor to pitch shift multiple channels received from the ADCs.

A further embodiment of the present invention would have any number of strings and associated transducers, ADC and DAC channels, associated channels of pitch-shifting DSP, and any number of pedals and knee levers.

A further embodiment of the present invention would have sensors attached directly to the pedals, which are in turn attached to the pedal bar/rack such that pedal rods would not be necessary. The sensors' electrical connections could be run from the pedal bar up to the circuit boards under the body of the instrument.

A further embodiment of the present invention would have sensors attached to the pedals directly with the pedals being free-standing.

A further embodiment of the present invention would use piezo-electric pickups as the transducers.

A further embodiment of the present invention would use optical pickups as the transducers.

A further embodiment of the present invention would use potentiometers as sensors for pedal travel, with each potentiometer's shaft coupled to a pedal or lever's cross rod, either directly or indirectly through a U-joint. As a pedal or knee lever is engaged and a cross rod turns, it would move the shaft of a rotary potentiometer and a variable voltage could be read from the potentiometer. The potentiometer would continuously send its variable output through the output wire to the micro-controller (MCU). A spring would have enough tension to give kinesthetic feedback in the form of resistance to the player and to return the pedal and potentiometer to their at rest positions.

A further embodiment of the present invention would use potentiometers as sensors for pedal travel, with each potentiometer's shaft coupled indirectly to a cross rod through a rack and pinion assembly. As a pedal or knee lever is engaged, the pedal rod would move downward, transferring its energy to a rack and pinion assembly which in turn rotates the potentiometer, with no deflection of its shaft. The potentiometer continuously would send its variable output through the output wire to the micro-controller (MCU). A spring would have enough tension to give kinesthetic feedback in the form of resistance to the player and to return the pedal and potentiometer to their at rest positions.

A further embodiment of the present invention would use potentiometers as sensors for pedal travel, with each potentiometer's shaft coupled indirectly to a cross rod through a pulley system. As a pedal or knee lever is engaged and a cross rod turns, it would move the shaft of a rotary potentiometer through strings or cords connection the cross rod shaft and the potentiometer's shaft, and a variable voltage could be read from the potentiometer. The potentiometer would continuously send its variable output through the output wire to the micro-controller (MCU). A spring would have enough tension to give kinesthetic feedback in the form of resistance to the player and to return the pedal and potentiometer to their at rest positions.

A further embodiment of the present invention would use a combination of infrared (IR) light emitters and IR phototransistor as sensors for pedal travel. As a pedal or knee lever is engaged, a vane attached to the cross rod would interrupt the IR beam from the emitter to a greater or lesser degree. The collector's output variable voltage could be read.

Another embodiment of the present invention would employ a slide potentiometer connected to each pedal, pedal rod, cross rod or other object connected in some way to each pedal. As the pedal moved, the movable portion of the slide potentiometer would move, and its output variable voltage could be read.

Another embodiment of the present invention would have knee levers that are adjustable in the left/right direction for the comfort of the musician. A track could hold assemblies, each comprising a knee lever and its associated sensor. Some method (e.g., a thumbscrew) would release the assembly so that it could slide along a track from left to right and be re-secured in a new position.

Another embodiment of the present invention would have knee levers that are adjustable in the front / back direction for the comfort of the musician. Each knee lever could be released, slid forward or backward, away from or closer to, the musician and then re-secured.

What is claimed is:

1. A pedal steel guitar comprising:

a body having a plurality of strings carried thereon;

at least one transducer carried by the body and positioned in proximity to the strings, the transducer producing an electronic transducer signal in response to vibration of at least one of the plurality of strings;

at least one foot pedal or knee lever carried by the body and being physically disengaged from the plurality of strings;

at least one sensor responsive to movement of the at least one foot pedal or knee lever, the sensor producing an electronic sensor signal;

a digital signal processor having inputs receptive of the electronic transducer signal and the electronic sensor signal;

the digital signal processor being configured and programmed to operate on the electronic transducer signal in the digital domain and to use the electronic sensor signal to manipulate at least one tonal property of the electronic sensor signal;

the digital signal processor being further configured to produce an audio output;

the digital signal processor being further configured with a programming input and being further programmed to change the manner in which the digital signal processor manipulates the at least one tonal property based on programming information received through the programming input.

2. The pedal steel guitar of claim 1 further comprising a plurality of foot pedals or knee levers carried by the body and being physically disengaged from the plurality of strings, and wherein the digital signal processor is programmed to change the manner in which at least one of the plurality of pedals or knee levers effects control over the at least one tonal property, based on the setting of a second one of the plurality of pedals or knee levers.

3. The pedal steel guitar of claim 1 wherein the digital signal processor is further programmed to cause the strings to define different chord inversions based on the setting of the at least one foot pedal or knee lever.

4. The pedal steel guitar of claim 1 wherein the strings each have an open state and wherein the digital signal processor is programmed to utilize copedent data stored in a non-transitory computer readable medium comprising information that defines the pitches of the open state of each string and information that defines what pitch changes are made to each string when said at least one foot pedal or knee lever is manipulated.

5. The pedal steel guitar of claim 4 further comprising a copedent control processor that is programmed to operate on said copedent data by performing operations selected from the group consisting of: modifying, saving to memory and recalling from memory the copedent data.

6. The pedal steel guitar of claim 4 further comprising a copedent control processor having a user interface, wherein the copedent control processor is programmed to operate on said copedent data by performing operations selected from the group consisting of: modifying, saving to memory and recalling from memory the copedent data in response to interaction by a user through the user interface.

7. The pedal steel guitar of claim 6 wherein the user interface is implemented by means of a touchscreen display.

8. The pedal steel guitar of claim 6 wherein the user interface is implemented by means of a display on an external device, selected from the group consisting of smartphone, tablet, computer, and a device that communicates with the pedal steel guitar via cable, or wifi.

9. The pedal steel guitar of claim 6 wherein the user interface is controlled by a processor separate from the copedent control processor.

10. The pedal steel guitar of claim 1 further comprising multiple digital signal processors that are programmed to process the multiple digitized signal outputs.

11. The pedal steel guitar of claim 6 wherein one processor is used for both controlling the user interface and manipulating and controlling copedents.

12. The pedal steel guitar of claim 1 wherein the at least one foot pedal or knee lever provides physical resistance and kinesthetic feedback to the player.

13. The pedal steel guitar of claim 12 wherein the at least one foot pedal or knee lever provides feedback that is adjustable in terms of the effort required and of the speed at which the at least one foot pedal or knee lever returns to an at-rest position.

14. The pedal steel guitar of claim 4 wherein the digital signal processor is programmed to output pitches of the open strings, based at least in part on a copedent data such that the pitches are selected from the group consisting of (1) being identical to the physically tuned open string pitch and (2) being different from the physically tuned open string pitch.

15. The pedal steel guitar of claim 1 further comprising a copedent control processor having a user interface through which a user can recall preset copedents, create new copedents, make alterations to existing copedents, save and recall newly altered or created copedents.

16. The pedal steel guitar of claim 1 wherein the digital signal processor is programed to produce output pitches of open strings that can be individually be adjusted to achieve standard pitch.

17. The pedal steel guitar of claim 1 wherein the digital signal processor is programmed to adjust the tuning of the audio output to achieve capo-like functionality in which all pitches can be adjusted either up or down in a predefined multiple of a semitone.

18. The pedal steel guitar of claim 1 wherein the digital signal processor is programmed to adjust the tuning of the audio output to produce output pitches of open strings as well as those pitches altered by means of engaging pedals and/or knee levers can be adjusted either up or down in increments smaller than a semitone to achieve fine tuning adjustments.

19. The pedal steel guitar of claim 1 further comprising a plurality of foot pedals and knee levers configured such that when engaged simultaneously the plurality of foot pedals and knee levers can be made to act in one of an additive fashion and in a priority fashion, wherein the additive fashion is characterized in that if a first one of said plurality of foot pedals and knee levers acting alone raises or lowers the pitch of a particular string's output by a first interval and a second one of said plurality of foot pedals and knee levers acting alone raises or lowers the pitch of the same string's output by a second interval, then fully engaging said first and second foot pedals and knee levers simultaneously will result in the pitch being raised an interval equal to the arithmetic sum of the first and second intervals; and the priority fashion being characterized in that if a first one of said plurality of foot pedals and knee levers acting alone raises or lowers the pitch of a particular string's output by some interval and a second one of said plurality of foot pedals and knee levers acting alone raises or lowers the pitch of the same string's output by second interval different from the first, then fully engaging said first and second of said plurality of foot pedals simultaneously will result in the pitch being changed by the interval of whichever of the first and second plurality of foot pedals and knee levers has been given priority.

20. The pedal steel guitar of claim 2 wherein the first of said plurality of pedals or knee levers changes the behavior of the second of said plurality of pedals or knee levers as follows:

while one said plurality of pedals or knee levers when engaged alone might raise or lower a particular string or strings, each by a certain interval, when a second of said plurality of pedals or knee levers is engaged, the first one said plurality of pedals or knee levers will affect a different string or strings and/or will affect them by different intervals.

21. The pedal steel guitar of claim 1 wherein the digital signal processor is programmed to produce one or more intermediate pitch intervals, in multiples of semitones, that are defined within a larger interval between a starting pitch of a string and an ending pitch such that as the pedal/knee lever travel approaches an intermediate point, the digitally shifted pitch is attracted to said intermediate pitch such that the output pitch can be heard to temporarily but accurately rest on said intermediate pitch, achieving a complex "half-pedal" capability.

22. The pedal steel guitar of claim 1 wherein the at least one foot pedal or knee lever is configured to effect a half-pedal capability on more than one string.

23. The pedal steel guitar of claim 21 wherein the digitally shifted pitch is attracted to more than one intermediate pitch such that the output pitch can be heard to temporarily but accurately rest on more than one intermediate pitch, achieving a complex "multi-position half-pedal" capability.

24. The pedal steel guitar of claim 21 wherein the digitally shifted pitch is attracted to an intermediate pitch lower than the at-rest pitch and then changes direction to a higher pitch than the intermediate pitch or is attracted to an intermediate pitch higher than the at-rest pitch and then changes direction to a lower pitch than said intermediate pitch, achieving a complex "multi-directional half-pedal" capability.

25. The pedal steel guitar of claim 18 wherein the digitally shifted pitches chosen for open strings and for strings altered by pedal or knee lever action are microtonal in nature, that is, other than whole multiples of semitones.

26. The pedal steel guitar of claim 5 wherein an external connector is used to communicate with an external device to export or import copedent data for saving and use.

27. The pedal steel guitar of claim 1 wherein an external connector is used to communicate with software running on an external device such that the external software can receive physical open string pitch data, copedent data which includes virtual open string pitch data and pedal and knee lever change data, along with physical strings' pre-pitch-shift pitch output data, and pedal and knee lever position data, such that the external software can automatically compute and record tablature in real time as the instrument is played.

28. The pedal steel guitar of claim 1 wherein each separate audio output signal is equalized and/or gain-adjusted separately and independently.

* * * * *